US011357347B1

(12) United States Patent
Mani

(10) Patent No.: US 11,357,347 B1
(45) Date of Patent: Jun. 14, 2022

(54) PORTABLE HEAD AND NECK SUPPORT PILLOW

(71) Applicant: Marc Mani, Beverly Hills, CA (US)

(72) Inventor: Marc Mani, Beverly Hills, CA (US)

( * ) Notice: Subject to any disclaimer, the term of this patent is extended or adjusted under 35 U.S.C. 154(b) by 0 days.

(21) Appl. No.: 17/531,684

(22) Filed: Nov. 19, 2021

Related U.S. Application Data

(63) Continuation-in-part of application No. 17/352,289, filed on Jun. 19, 2021, which is a continuation of application No. 17/100,296, filed on Nov. 20, 2020, now Pat. No. 11,160,400.

(60) Provisional application No. 63/274,321, filed on Nov. 1, 2021.

(51) Int. Cl.
*A47G 9/10* (2006.01)

(52) U.S. Cl.
CPC ..... *A47G 9/1081* (2013.01); *A47G 9/1045* (2013.01); *A47G 2009/1018* (2013.01)

(58) Field of Classification Search
CPC ..... A47G 9/1081; A47G 9/1045; A47G 2009/1018
See application file for complete search history.

(56) References Cited

U.S. PATENT DOCUMENTS 4,031,578 A 6/1977 Sweeney
4,447,922 A * 5/1984 Brochu ..... A61G 13/121 5/640
4,794,656 A * 1/1989 Henley, Jr. ..... A61G 1/01 5/628
D396,594 S * 8/1998 Lefebvre ..... D6/601
D407,256 S 3/1999 Backlund
6,010,192 A 1/2000 King
8,161,588 B1 4/2012 Anson
8,327,483 B1 * 12/2012 Zamora ..... A47G 9/10 5/636
8,566,986 B1 10/2013 Chu
8,584,285 B1 * 11/2013 Sipherd ..... A47C 7/383 5/636
8,898,849 B2 12/2014 Majette
(Continued)

FOREIGN PATENT DOCUMENTS

GB 2510644 A 8/2014
KR 101538695 B 7/2015
(Continued)

*Primary Examiner* — Myles A Throop

(57) ABSTRACT

The support pillow assembly includes a portable support pillow designed to provide optimal head and adjacent neck support for the user in upright and/or reclined seated and supine positions. The pillow is optionally configured with a hole to securely support the occiput. The pillow may be configured in a taller or shorter profile. The pillow is tapered in a manner that maintains the user's neck and head in proper alignment. The support pillow assembly is constructed of single piece foam which is firm enough and contoured to prevent head turning and neck torsion. The support pillow is optionally configured with exterior support panels to provide additional utility, compressibility, stability, and comfort. The support pillow assembly optionally includes an adjustable strap that may be used to provide supplemental support to the head. It may be collapsed into a portable pillow comprising protective exterior supports, a cloth or similarly soft bag, or a protective case.

16 Claims, 44 Drawing Sheets

(56) References Cited

U.S. PATENT DOCUMENTS

| | | | | |
|---|---|---|---|---|
| D725,407 | S * | 3/2015 | McCracken | D6/601 |
| 9,434,283 | B2 * | 9/2016 | Spalter | A47C 7/383 |
| D769,029 | S * | 10/2016 | Okwumabua | A47C 7/383<br>D6/601 |
| D787,232 | S | 5/2017 | Arabo | |
| D808,195 | S | 1/2018 | Wybom | |
| D823,026 | S * | 7/2018 | Shi | A47C 7/383<br>D6/601 |
| D910,339 | S | 2/2021 | Dennewald | |
| D913,012 | S | 3/2021 | Krishtul | |
| D915,104 | S * | 4/2021 | Yang | D6/601 |
| 11,160,400 | B1 * | 11/2021 | Mani | A47C 7/383 |
| 2006/0267392 | A1 | 11/2006 | Charnitski | |
| 2007/0022537 | A1 * | 2/2007 | Faustick | A47D 13/08<br>128/845 |
| 2010/0237677 | A1 * | 9/2010 | Nam | A47G 9/10<br>297/391 |
| 2010/0294284 | A1 | 11/2010 | Hohenhorst | |
| 2011/0271964 | A1 | 11/2011 | Zhang | |
| 2012/0110742 | A1 * | 5/2012 | Lawler | A61G 13/121<br>5/636 |
| 2013/0232693 | A1 * | 9/2013 | Myers | A47G 9/10<br>5/636 |
| 2015/0121626 | A1 | 5/2015 | Carver | |
| 2015/0257555 | A1 | 9/2015 | Wong | |
| 2015/0327698 | A1 | 11/2015 | Walker | |
| 2016/0114708 | A1 | 4/2016 | Spalter | |
| 2018/0146807 | A1 | 5/2018 | Silver | |
| 2019/0008294 | A1 | 1/2019 | Marshall | |
| 2019/0182593 | A1 | 6/2019 | Guerrini | |
| 2019/0231099 | A1 | 8/2019 | Davis | |
| 2020/0154914 | A1 * | 5/2020 | Popitz | A47G 9/109 |
| 2021/0153660 | A1 * | 5/2021 | Gockel | B60N 2/885 |

FOREIGN PATENT DOCUMENTS

| | | | |
|---|---|---|---|
| KR | 20150092658 | A | 8/2015 |
| WO | 2019031670 | A1 | 2/2019 |

* cited by examiner

PORTABLE HEAD AND NECK SUPPORT PILLOW

CROSS-REFERENCE

This application is a continuation-in-part of U.S. application Ser. No. 17/352,289, filed Jun. 19, 2021, which is a continuation of U.S. application Ser. No. 17/100,296, filed Nov. 20, 2020, now U.S. Pat. No. 11,160,400, issued, Nov. 2, 2021, and claims the benefit of U.S. Provisional Application Ser. No. 63/274,321, filed Nov. 1, 2021, all of which are expressly incorporated herein by reference.

FIELD OF INVENTION

The present invention relates to a portable head and neck support pillow that is configured to provide optimal support and comfort. More specifically, the present invention provides an improved pillow which supports the neck and head of a user in both supine and upright positions as well as in seated positions where the user is reclining. The utility of the pillow disclosed herein, however, is not limited to travel. It may also be used in a medical setting, where maintaining optimal head and neck support is necessary.

BACKGROUND OF THE INVENTION

A pillow generally provides cushioning for the head and neck, typically in a supine position. Typically, support pillows, such as travel pillows, provide firm support to the neck in a manner designed to prevent a user's head from dropping forward or back or falling to one side or another. A travel pillow typically must support the head and neck while the user is in a moving vehicle, often while in a seated and/or reclining positions in a range of angles, as is common during long journeys in automobiles, trains, buses, airplanes and the like. A common problem for the travelers is not being able to sleep when traveling. Another is the inability of travelers to rest comfortably during long waits at stations or airports, where the lack of headrests makes resting difficult and uncomfortable.

SUMMARY OF THE INVENTION

The present invention provides an improved support pillow which may be used for resting and sleeping in home or while traveling, for instance on an airplane. The support pillow assembly comprises a support pillow configured to optimally support the neck and head of a user in upright, supine and/or seated positions, and ranges in between. In one or more embodiments the pillow disclosed herein includes a strap to better secure the invention to the user's head. The support pillow assembly further includes a pair of side rests that extend from the shoulders to the top of the user's head, while in an upright position. The support pillow further includes a headrest in between the pair of side rests for supporting the occiput portion of the head. The head rest is slightly depressed in comparison with the pair of side rests, to align the head and neck of the user in the forward position while the user's head is in supine or erect position or in a reclined angle position in between supine and erect.

The head rest of the support pillow further includes a top portion, a central portion and a bottom portion. The bottom portion of the support pillow is configured into an arch shape that is designed wrap around the back of the neck and rest on the shoulders of the user. Further, the arch extends from one side rest to the other side rest. The top of the arch is at the base of the head rest and the bottom of the arch is at the base of the side rests and rests on the shoulders to the front of the user's chest. The central portion of the head rest supports the middle portion of the head. In some embodiments the central portion further includes a hole for supporting the occiput or occipital part of the head. Moreover, the region from the central portion of the back of the headrest to the lower portion of the arch is tapered for maintaining the neck in proper alignment, while the user is reclining. The top portion of the headrest supports the posterior part of the head. The top portion of the headrest is tapered for accommodating the head in proper alignment, while resting. In some embodiments, however, the support pillow need not have a hole.

In some embodiments the pillow is configured to support the neck and head of a user in the supine, inclined or upright position. The pillow comprises a headrest portion, a first and second side rest for supporting the head of the user, wherein the headrest portion is positioned between the side rests and wherein the headrest portion comprises a curved interior for supporting the posterior part of the head and neck, having a larger radius at its upper portion that tapers to a smaller radius at its lower portion, an arch-shaped bottom portion, wherein the bottom portion rests on the nape of the neck of the user, further wherein top of the arch shaped bottom portion is positioned at base of the head rest and the bottom of the arch shaped bottom portion is positioned at the base of the side rests, first and second ear recesses on first and second lateral sides of the headrest portion, wherein said ear recesses are configured to receive the ears of the user, and first and second trapezius recesses on the bottom of first and second sides of the arch-shaped bottom portion, said trapezius recesses configured to receive the trapezius muscle of the user.

The support pillow further optionally includes a strap placed at bottom of the headrest for supporting the support pillow in place relative to the head. The strap may be attached to the headrest such that it tightens from side to side to secure the headrest against the user's head. The strap may be further wrapped around the neck starting from one of the pair of side rests via the headrest to connect with other side rest. Furthermore, the strap further includes a connector to secure one side of the strap with the other. The connector here is either of a button, Velcro® hook and loop assembly, hooks, and/or buckles and the like to connect the strap together. It will be appreciated that the strap may be used in different configurations so long as it secures the headrest against the user's head.

A primary objective of the present invention is to provide a support pillow assembly for supporting neck and head of a user in positions from supine to seated in a reclined angle or erect. The support pillow portion may be made from a single piece of foam that is firm enough to accomplish support against the head movement in a reclined seated position such as in an airplane or in an upright position. In one embodiment, an additional softer layer of foam, such as visco-elastic foam (memory foam or low-resilience polyurethane foam (LRPu)) or TopiFoam®, may be used as the inside layer of the support pillow, cradling the head and neck for purposes of greater comfort. In some embodiments, blow-up air bladders are incorporated within the foam to create, among other utility, greater ability for the user to deflate and store it in a book-sized case, soft cloth-type bag or other means to compact the pillow between uses in a user-friendly and size-minimizing manner to carry in a bag, case, or the like.

In some embodiments the pillow may be made from bio-based, including plant-based, materials, such as but not limited to coconut, corn, flax, hemp, jute, sisal, soybeans, corn starch, hemp, natural fibers and the like. In some embodiments the pillow may be made from biodegradable material, such a green cell foam, corn starch, milk and clay mixes, myco-composite, and the like. In some embodiments the pillow described herein is made from a combination of conventional materials and bio-based materials. By "bio-based" is meant derived from living material such as plants or other natural materials. In some embodiments the pillow is from 5% to 95% bio-based, 10% to 80% bio-based, 20%-70% bio-based, 30%-60% biobased or 40%-50% bio-based. In some embodiments the pillow is around 20%, 25%, 30%, 35%, 40%, 45%, 50%, 55%, 60%, 65%, 70%, 75%, 80%, 85%, 90%, or 95% bio-based.

An objective of the present invention is to provide a firmly constructed yet comfortable soft support pillow that provides optimal support to the head and neck while the user is resting or travelling in an upright and/or a supine position, a position in between while seated, or in a seated reclining position.

Another objective of the present invention is to provide a support pillow assembly that is strong enough to provide support against head movement and neck torsion which is the main impediment to sleep in the upright or reclined seated position such as in an airplane.

Yet another objective of the present invention is to provide a support pillow assembly that is made up of single piece polyester, polyurethane, latex, visco-elastic or memory foam.

Another objective of the present invention is to provide a support pillow assembly which has a concave recess for the occiput to rest and which contours to the cervical region to support its natural lordosis, when the user reclines the head while resting or travelling.

In some embodiments the disclosure provides a collapsible pillow for supporting the neck and head of a user in supine position. In some embodiments, the pillow assembly comprises a headrest portion and a first and second side rest for supporting the head of the user, wherein the headrest portion is positioned between the side rests and wherein the headrest portion comprises a curved interior for supporting posterior part of the head. In addition, the support pillow comprises an arch-shaped bottom portion, wherein the bottom portion rests on shoulder of the user, further wherein top of the arch shaped bottom portion is positioned at base of the head rest and the bottom of the arch shaped bottom portion is positioned at the base of the pair of side rests. The pillow also comprises a rigid support on the back of the pillow, a rigid support on the front of the first side rest; and a rigid support on the exterior of the second side rest. In some embodiments the pillow further contains a notch on the interior of said first side rest, the notch being configured to receive a front, interior edge of said second side rest.

In some embodiments rigid support on the back of the pillow covers 60% of the back of the pillow. In some embodiments rigid support is aligned flush with the exterior of the first side rest. In some embodiments the present disclosure provides a method of carrying a portable pillow comprising folding the second side rest of the collapsible pillow as described herein, toward the first side rest and lodging the interior edge of the second side rest in the notch in the first side rest.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

Although the invention is described above in terms of various exemplary embodiments and implementations, it should be understood that the various features, aspects and functionality described in one or more of the individual embodiments are not limited in their applicability to the particular embodiment with which they are described, but instead can be applied, alone or in various combinations, to one or more of the other embodiments of the invention, whether or not such embodiments are described and whether or not such features are presented as being a part of a described embodiment. Thus, the breadth and scope of the present invention should not be limited by any of the above-described exemplary embodiments.

The presence of broadening words and phrases such as "around," "about," "one or more," "at least," "but not limited to" or other like phrases in some instances shall not be read to mean that the narrower case is intended or required in instances where such broadening phrases may be absent. By "around" or "about" is meant that a measurement is within 10% higher or lower than a recited measurement.

BRIEF DESCRIPTION OF DRAWINGS

The objects and features of the present invention will become more fully apparent from the following description and appended claims, taken in conjunction with the accompanying drawings. Understanding that these drawings depict only typical embodiments of the invention and are, therefore, not to be considered limiting of its scope, the invention will be described and explained with additional specificity and detail through the use of the accompanying drawings in which:

FIG. 2 (B) illustrates a back view of the headrest of the support pillow in accordance with the present invention. FIG. 2 (C) illustrates a side view of the headrest of the support pillow from the head on view, in accordance with the present invention. FIG. 2 (D) illustrates a side view of the headrest of the support pillow from the head on view, in accordance with the present invention. FIG. 2 (E) illustrates a top view of the headrest of the support pillow in accordance with the present invention. FIG. 2 (F) illustrates a bottom view of the headrest of the support pillow in accordance with the present invention.

FIG. 13 (B) depicts a perspective view of a folded support pillow described herein; FIG. 13 (C) depicts an inferior view of a folded and compressed support pillow described herein; FIG. 13 (D) depicts a front view of a folded support pillow described herein; FIG. 13 (E) depicts a posterior view of the support pillow described herein showing a sliding back plate in extended position; FIG. 13 (F) depicts an inferior view of the folded pillow when folded from side to side; FIG. 13 (G) depicts an inferior view of the folded and compressed pillow when folded from side to side.

FIG. 37 (A) shows a closed, one-hinge system. FIG. 37 (B) shows an open, one-hinge system. FIG. 37 (C) shows a closed, two-hinge system. FIG. 37 (D) shows an open, two-hinge system.

FIG. 43 (B) depicts a pillow compressed by the attachable elastic band(s). FIG. 43 (C) depicts an alternative configuration of a pillow with an attachable elastic band, or pair of bands, to use for compression to a smaller size. FIG. 43 (D) depicts an alternative configuration of a pillow compressed by the attachable elastic band or bands.

DETAILED DESCRIPTION

Figure 1:
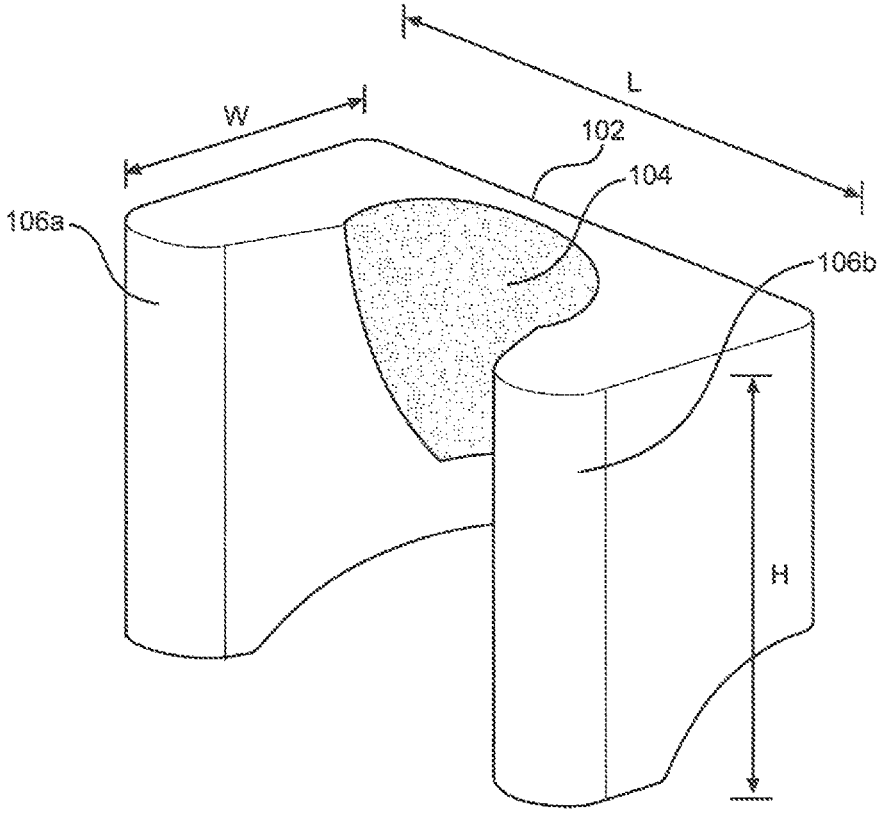
FIG. 1 illustrates a perspective view of a support pillow.
Figure 2A:
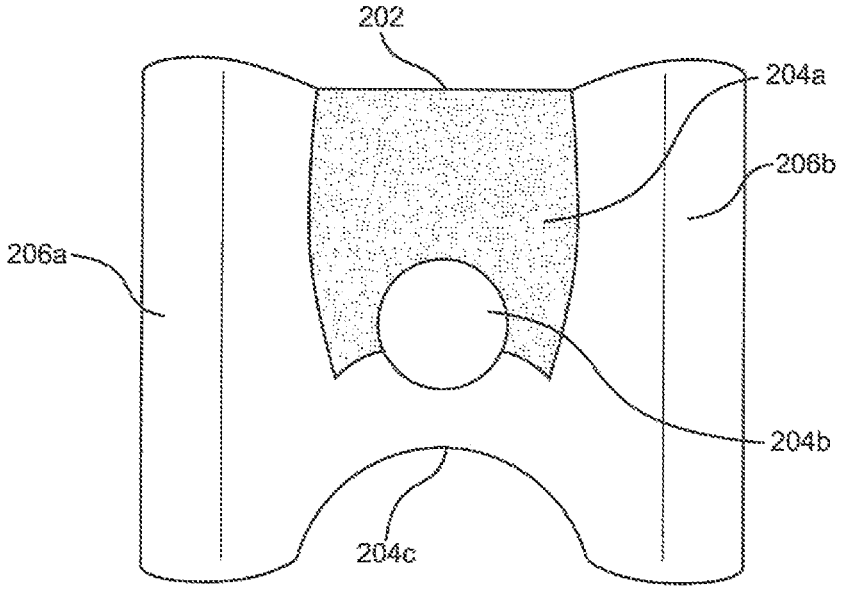
FIG. 2 (A) illustrates a front view of a headrest of the support pillow in accordance with the present invention.
Figure 2B:
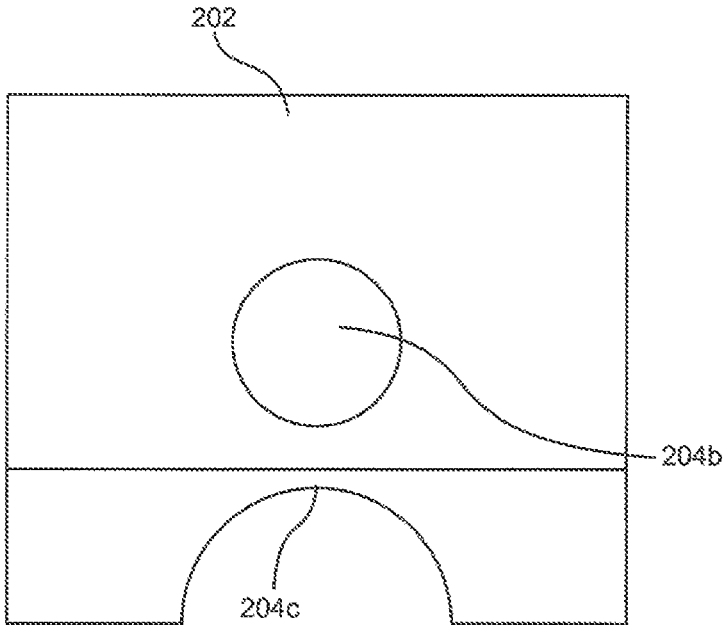
Figure 2C:
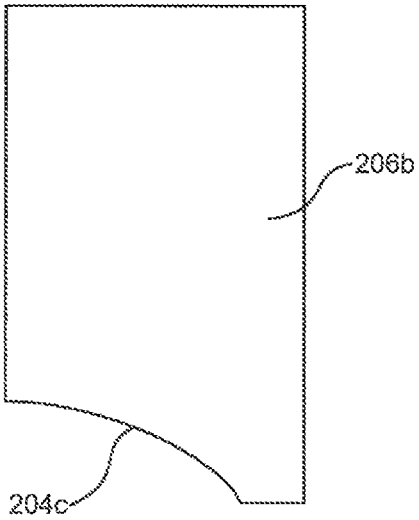
Figure 2D:
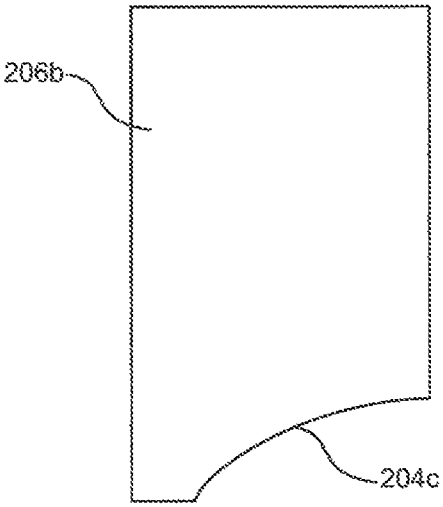
Figure 2E:
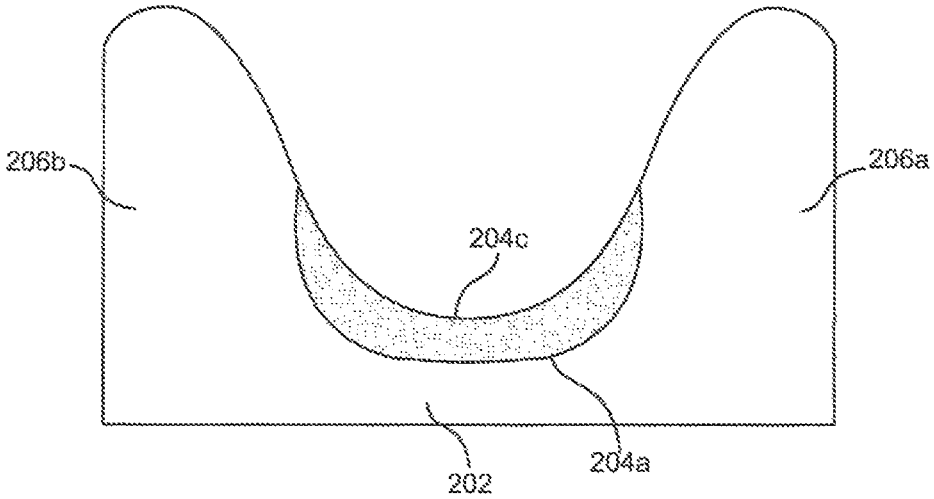
Figure 2F:
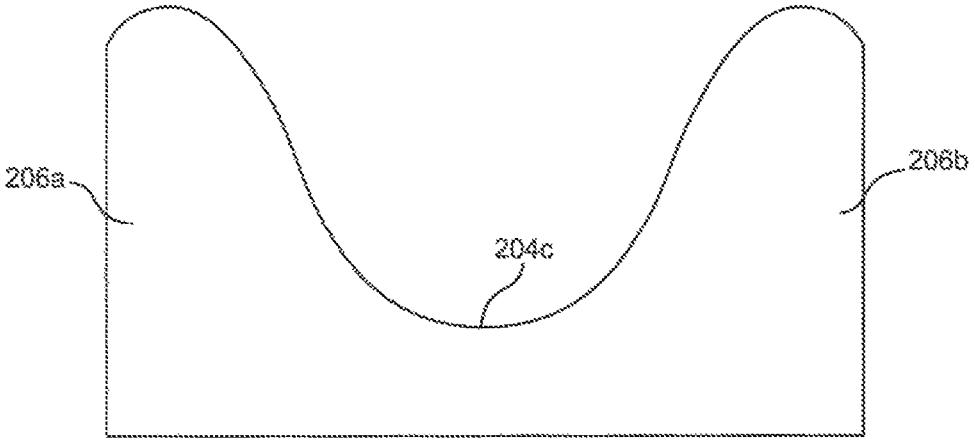

A variety of travel pillows have been described. One such example is described in U.S. Pat. No. 9,434,283 assigned to Danami LLC disclosing a travel pillow for use on vehicle seats, for example on airplanes especially during long trips. The travel pillow provides support to the head in the anterior direction while restricting any twisting movement of the head in the forward direction and/or the lateral direction. Though the pillow described therein provides support to the head and neck of the person, it is too bulky around the back of the neck in a way that particularly compromises its usefulness in the inclined or upright position as it forces the head and neck forward, and moreover does not rest on the shoulders when used in the inclined or upright position, preventing it from adequately stabilizing the head and neck, as is requisite for resting or sleeping in those positions.

Another Korean Patent KR101538695 assigned to Young-hwan Park discloses a three-dimensional pillow that allows resting comfortably while sitting on a chair by allowing the head and neck portions to maintain a stable posture at all times while travelling. The travel pillow described therein may provide adequate support to the neck and head of the person while the person is sleeping. However, the pillow does not provide enough space for aligning the neck in upright or erect position.

Another example is U.S. Pat. No. 8,584,285B1 assigned to Ryan Sipherd which discloses a U-shaped travel pillow contoured for neck support and lateral head support. This pillow supports the head and neck posteriorly but depends upon a "deflection relief" slot posteriorly to bend the head buttresses inward to provide lateral support to the head and neck. This design lacks head buttresses of adequate depth to provide head and neck support laterally and does not rest upon or contour to the shoulders in a way that resists lateral head and neck movement or twisting while in the semi-reclined or upright seated position.

In view of the defects in design of the travel pillows in the prior art, there exists a significant need for an improved pillow to optimally and comfortably stabilize the head and/or neck of a user. This is generally described herein as a support pillow and in some embodiments is referred to as a travel pillow. Notably, there exists a need for a support pillow that is tailored and customized to maximize comfort of the user. For instance, there exists a need to develop a support pillow that will not push the head forward or allow the head to fall in a forward, rearward or sideward position.

Accordingly, the present disclosure provides an improved support pillow that is configured to support a user's head and/or neck in multiple positions while resting or sleeping in the upright or reclined seated position such as in an airplane. By "recline" is meant any degree of recline from upright to flat on the user's back.

In some embodiments the pillow finds use in a medical setting. In this embodiment, the pillow need not be used in travel but may find use in a hospital, physician's office or patient's home following surgery. It is appreciated that following many surgical procedures the patient should or must stay in an upright or back and/or head-elevated position, even when sleeping, in some instances, at all times. Existing pillows fail to provide the necessary degree of support and patients report that they frequently struggle to maintain the correct position. The pillow described herein, however, provides sufficient support to the posterior of the head as well as the sides to prevent problematic lateral movement that is too often experienced by patients using other pillows. Accordingly, the present pillow finds use in recovery at a medical facility, hotel, or home. In some embodiments it finds use as an adjunct device for immobilizing (keeping still) the head and neck for therapeutic or health-based reasons such as when combined with the use of a CPAP (continuous positive airway pressure) machine, supplementary oxygen, or the like; and for better sleep for those with diagnosed conditions or psychological/physiological/comfort preference for back-positioned sleep or the entire spectrum of medical or post-surgical conditions that require the patient to sleep exclusively or predominantly in either a strictly supine or inclined (back elevated any amount up to and including 90 degree upright) position. Apart from the above, such conditions include but are not limited to pulmonary and cardiac ailments where inclined or upright positioning is necessary to force edema fluid to shift caudally (toward the base of the thoracic cavity) and/or improve the excursion of the diaphragm, or otherwise ameliorate symptoms including but not limited to orthopnea and paroxysmal nocturnal dyspnea (PND). In these medical embodiments the pillow may have wider dimensions for stability, with the sides of the head rests (106*a* and 106*b* or 206*a* and 206*b*) increased from the 1-2" up to 5-7" depicted in FIG. 1 and FIG. 2, respectively. In some embodiments the present invention allows for the shoulders and upper back to provide further support to the head and neck when not in a fully supine position"

The pillow may be constructed from a single piece or multiple pieces of foam that provide excellent vertical support, lateral support and cushioning to the user's head. In some embodiments of the pillow, blow-up air bladders may be incorporated within the foam. The head rest is soft yet strong enough to provide support against head rotation and neck torsion, in a reclined seated position such as in an airplane or sleeping in a position inclined upward at any angle relative to the supine position. The pillow has a concave recess for the back portion of the head to rest and contours to the cervical region to support its natural lordosis.

Figure 38:
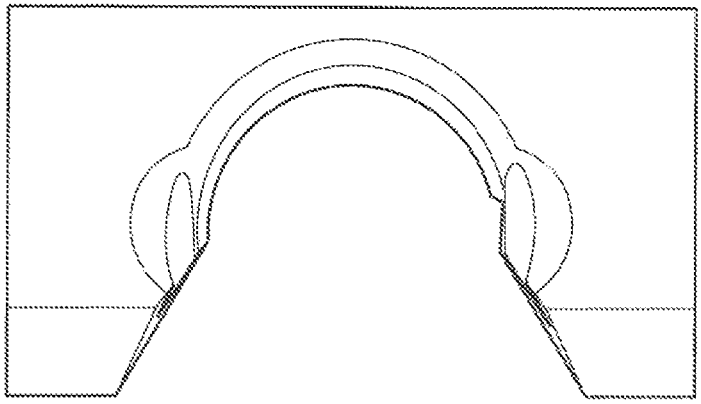
FIG. 38 depicts the viscoelastic (memory foam) or similar soft foam insert.

FIG. 1 illustrates a perspective view of one embodiment of the support pillow (102) embodying aspects of the present invention. The support pillow has a length (l), height (h) and width (w) and the pillow (102) is configured to support the neck and/or head of a user, while the user is resting in seated position. The support pillow (102) also provides vertical and lateral support to the head of the user. The support pillow (102) further comprises a head rest (104) and a pair of side rests (106), the latter of which in some embodiments may be identical with each other, and that are configured to cover the left and right side of the user's head. Each side rest (106*a*, 106*b*) is configured to cover the left side and right side of the user's head, from shoulder to the temporo-parietal portion of the head. The support pillow (102) can be customized according to the user, i.e. may be sized and shaped to match the approximate shape of the user's head. In some embodiments the support pillow is configured to receive an average sized human head. Each side rest (106*a*, 106*b*) may be sized or otherwise configured with recesses which comfortably accommodate the ears when the head is at least in the center forward facing position. In some embodiments, the pillow is configured with ear holes or recessed troughs on the sides of the pillow so that the pillow contacts the head without significantly compressing the user's ears. In some embodiments an additional softer layer of foam measuring from ¼" to 1" in thickness lines the inside of the pillow. This layer of foam is placed within the head/neck recess such that its dimensions match the current radius plus or minus ½". It may be made of softer foam than the remainder of the pillow such as visco-elastic foam (memory foam or low-resilience polyurethane foam (LRPu)), TopiFoam®, or similar softer foam or material. (See FIG. 38).

The headrest (104) of the support pillow further is concavely recessed between the pair of side rests (106) for supporting the back portion of the head. The head rest (104) is depressed inwards, to align the head and neck of the user in the forward, "anatomical", position, when the user is resting or sleeping such as during travelling. The head rest (104) of the support pillow (102) further includes a top portion, a central portion and a bottom portion.

The top portion of the head rest (104) of the support pillow (102) supports the posterior (occipital) part and side (temporo-parietal) part the head of the user. In one embodiment of the present invention, the top portion of the head rest (104) is tapered for accommodating head in proper alignment, while the user reclines their head during resting. The central portion of the head rest (104) of the support pillow (102) supports the middle portion of the head. The central portion further comprises a hole, in some embodiments, for supporting the occiput part of the head. In the shorter embodiment of the support pillow (diagrammed in FIG. 32(A)-36(B)), the top portion of the head rest supports the posterior head and neck around the level of the mastoid or craniocervical junction.

The bottom portion of the support pillow (102) has an arcuate shape for resting the support pillow (102) on the shoulder of the user, ensuring that it remains in position without falling off the shoulder and providing the necessary stability to the pillow and consequently the head and neck of the user. In one embodiment of the present invention, the top of the arc-shape bottom portion is at the base of the head rest (104) and bottom of the same lie at the base of the side rest (106*a*, 106*b*) of the support pillow (102) and is arched toward the front of the user such that the bottom of the sides rest on the clavicles, shoulders, and/or the chest of the user.

The support pillow (102) may be made up of a single piece foam material. The single piece foam material is designed and configured in a way to form a head and neck supporting portion of the support pillow (102). Primarily, the single piece support pillow (102) includes a pair of side rests (106) on each side of a head rest (104), the side rests (106) are angled upwards with respect to the head rest (104), for supporting the left and right portions of the head. The thickness of the head rest (104) symmetrically reduces towards the midline of the pillow (102). Alternatively, the single piece support pillow (102) includes a pair of side rests (106) on each side of a head rest (104). In some embodiments the pair of side rests (106) are not identical. Customization of the side rests is also envisioned to accommodate a variety of anatomic variations and/or preferences among users. This customization is envisioned to occur, among other means, based upon manual and/or three-dimensional digital imaging of the user's head, neck, and shoulder dimensions.

In one embodiment of the present invention, the support pillow (102) is made up of a conformable foam material that conforms to the shape of head, neck and shoulder of the user, and this support provides additional comfort and stability on the shoulder. In some embodiments the support pillow (102) is constructed from a memory foam or visco-elastic foam. In alternative embodiment, the foam is either a polyurethane foam or latex foam.

The main body of the device may be made from high pressure compression molded polyether urethane at approximately a 0.25-1 lb/cu·ft. density, or some other type of foam with the appropriate softness and resiliency to provide a balanced firm construction for stability and adequate softness for comfort. In some embodiments the density is from 0.25 to 5 lb/cu·ft., or from 0.5 to 1.5 lb/cu·ft. The devices may be machine cut into the material or may be molded as is known in the art.

In one embodiment, the foam or other external material(s) are coated with a layer that allows for surface cleaning and sterilization and improves comfort and appearance. In some embodiments this lining may be smooth polyurethane or plastic and may be from 0.01 to around 2.5 mm thick. In some embodiments it may be from 0.5 to 2 mm thick. This layer may be applied through an exterior spraying process or through an alternate method of foam manufacturing which generates this external layer as an integral part of the foam's exterior surface.

The pillow may be exposed to a variety of elements including dirt and grime, blood, sweat, tears, viruses, including SARS-Cov-2, bacteria and other pathogens. The surface coating (or simply the external surface of the pillow) provides the unique and timely advantage of not requiring a washing machine or hand washing process, which is not as readily available when traveling away from home or conveniences normally available at or near home; substituting instead a simple wipe down with alcohol or other disinfectant which is at once more convenient and more effective. In some embodiments, the surface of the pillow and/or the pillow itself may be impregnated with copper or other substances known to have anti-microbial properties, including resistance to Covid 19 and other contagious viruses and pathogens.

In an alternative embodiment, the support pillow (102) may also be provided with a removable cover or case to protect the pillow, which may be removed for cleaning or replacement thereof. The removable cover may be designed as per the dimensions and design of the support pillow (102) or in a looser fashion. The cover of the support pillow (102) is fabricated primarily of a soft fabric, such as fleece, cotton, or silk. Other materials may be used depending upon environmental considerations, health and microbial concerns, or user preferences.

FIG. 2 (A) illustrates a front view of support pillow (202) constructed by the single piece foam showing the head rest (204) and a pair of side rest (206*a*, 206*b*) of the support pillow (202). Primarily, the head rest (204) includes a top portion (204*a*), a central portion with a head rest hole (204*b*) and the head rest bottom (204*c*). In some embodiments the central portion does not have a hole. In some embodiments the top portion is tapered from thicker at the top to thinner towards the head rest hole (204*b*). In some embodiments the bottom portion (204*c*) is tapered from thicker at the bottom and thinner toward the head rest hole (204*b*). The head rest hole (204*b*) is configured to support the occiput of the head of the user. The bottom portion (204*c*) is configured in an arch shape. In some embodiments, the hole can also act as a drink holder or tray table, when the support pillow (202) is not in use or when the pillow is placed face down over knee of the user. In one embodiment of the present invention, the shape of the hole (204*b*) is circular.

In alternative embodiments of the present invention, the shape of the hole (204*b*) is either an elliptical, square, triangular or any other shape. In alternative embodiment of the present invention, the diameter of the hole (204*b*) is around from 2-15 cm. In some embodiments the diameter of the hole is from 5-10 cm. In some embodiments the hole is from 6-8 cm and in some embodiments the hole is around 7 cm in diameter. In some embodiments there is no hole in the back of the pillow. In some embodiments the length of the support pillow (202) ranges from around 20-60 cm. It is appreciated by those of ordinary skill in the art that some measurements disclosed herein are made in cm (metric) while others are listed in inches (Imperial). These measurements are readily convertible by using the conversion: 1 inch=2.54 cm.

In some embodiments the length of the support pillow may be from around 25-50 cm or from 30 to 40 cm. More particularly, the length of the support pillow (202) is around 30 cm. In some embodiments, particularly when the support pillow is to be used in medical applications the total length of the headrest is increased up to around 60 cm.

In one embodiment the top portion is for supporting the posterior part of the head and is tapered to create a concavely recessed region that extends from the bottom of the top portion to the top of the top portion. In some embodiments the concave region is recessed from 9 cm to 13 cm relative to the plane made from the front of each side of the pillow, and the concavely recessed region comprises a radius of curvature that is longer at the top than the radius of curvature at the bottom of the concavely recessed region. In one embodiment the concavely recessed region is configured to support the posterior part of the head and neck and to maintain the head and neck in proper alignment.

In one embodiment the top portion comprises a concavely recessed region that extends from the bottom of the top portion to the top of the top portion, wherein the concave region is either a semicircular or semi-elliptical shape when seen from the superior or inferior view, ranging from 180 degrees to 220 degrees of a full circle, preferably between 205 and 215 degrees, with a radius (exact if circular, average if elliptical) at the top of the top portion of between 4 cm and 10 cm, preferably between 5 and 8 cm; cm, and at the bottom of the top portion between 3 cm and 8 cm, preferably between 4.5 cm and 6 cm; and tapering evenly between those two radii in a partial inverted, truncated-cone shape.

In one embodiment the top portion comprises a concavely recessed region that extends from the bottom of the top portion to the top of the top portion, wherein the concave region is either a semicircular or semi-elliptical shape when seen from the superior or inferior view, ranging from 180 degrees to 220 degrees of a full circle, preferably between 205 and 215 degrees, with a radius (exact if circular, average if elliptical) at the at the top of the top portion of between 4 cm and 10 cm, preferably between 5 and 8 cm; cm, and at the bottom of the top portion between 3 cm and 8 cm, preferably between 4.5 cm and 6 cm, and tapering evenly between those two radii in a shape that matches that of the average posterior human male head and neck (see attached diagrams), or the average posterior female head and neck, and human head and neck contours matching the sizes interposed between the average male and average female as well as those head sizes between 1 and 10 percent larger than the average male head and neck (which has a circumference of 57 cm (22½ inches) between 1 and 10 percent smaller than the average female head and neck (which has a circumference of 55 cm (22¾ inches).

In an embodiment, the width of the head rest at its top portion (204) ranges from around 8 cm to around 20 cm. More particularly described, the width of the head rest (204) is around 9 cm to 14 cm cm. Moreover, the height of the head rest (204) ranges from 10 cm to 26 cm. More particularly, the height of the head rest portion (204) ranges from to 17.5 cm at its posterior most point to 21.25 cm at its most anterior point.

The bottom portion (204*c*) of the head rest (204) is curved in an arc shape at some height from the bottom of the side rest (206*a*, 206*b*). For instance, the height at which the bottom portion is configured in an arc-shape, ranges from around 6 cm to around 16 cm. More particularly, the height of the arc shaped bottom portion the side rest (206) is around 6 cm from the bottom of the pillow to the bottom of the head rest (204). In other words, the distance between the top of the arch which is at the base of the headrest (204) and the bottom of the arch, which is at the anterior base of the side rest (206*a*, 206*b*) is around 6 cm. This distance can range from 4 cm to 8 cm.

Also as further depicted in FIG. 2 (A), it is evident that the side rests (206*a*, 206*b*) are separated at specific distance, depending upon the head, neck and shoulder anatomy of the user, so that the support pillow easily accommodates users of varying sizes. The distance between the side rests (206*a*, 206*b*) ranges from around 9 cm to around 26 cm. More particularly, the distance between the side rests (206*a*, 206*b*) is around 12 cm to 16 cm. In some embodiments the distance between the side rests is 9, 10, 11, 12, 13, 14, 15, 16, 17, 18, 19, 20, 21, 22, 23, 24, 25 or 26 cm. In some embodiments the length of the support pillow (202) is around 25-60 cm. In some embodiments the length of the support pillow is around 25, 26, 27, 28, 29, 30, 31, 32, 33, 34, 35, 36, 37, 38, 39, 40, 41, 42, 43, 44, 45, 46, 47, 48, 49, 50, 51, 52, 53, 54, 55, 56, 57, 58, 59, or 60 cm. More particularly, the length of the support pillow (202) is around 27 cm.

FIG. 2 (B) illustrates a back view of support pillow (202) constructed by the single piece foam showing the posterior portion of the support pillow (202). The length of the support pillow (202) is around 25-40 cm in some embodiments. In some embodiments the length of the support pillow is around 25, 26, 27, 28, 29, 30, 31, 32, 33, 34, 35, 36, 37, 38, 39, 40, 41, 42, 43, 44, 45, 46, 47, 48, 49, 50, 51, 52, 53, 54, 55, 56, 57, 58, 59, or 60 cm. More particularly, the length of the support pillow (202) is around 27 cm.

FIG. 2 (C) illustrates a side view of headrest of the support pillow (202) constructed by the single piece foam showing a view of the side rest (206*a*) of the support pillow (202). The anterior of the support pillow is to the right. The posterior of the support pillow is to the left. In an embodiment in accordance to the invention, the side rest (206*a*) has a height ranging from around 20 cm to around 35 cm. In some embodiments the side rest has a height of around 20, 21, 22, 23, 24, 25, 26, 27, 28, 29, 30, 31, 32, 33, 34 or 35 cm. More particularly, the height of the side rest (206) is around 22 cm. For a larger or smaller sized pillow, the dimensions of the support pillow (202) would be increased or decreased, respectively, to accommodate the head, neck, and shoulder anatomy of a user of that size, the same being known to one of ordinary skill in the art.

FIG. 2 (D) illustrates a side view of support pillow (202) constructed by the single piece foam showing a view of the side rest (206*b*) of the support pillow (202). The anterior of the support pillow is to the left. The posterior of the support pillow is to the right. The side rest (206*b*) has a height ranging from around 20 cm to around 35 cm. In some embodiments the side rest has a height of around 20, 21, 22, 23, 24, 25, 26, 27, 28, 29, 30, 31, 32, 33, 34 or 35 cm. More particularly, the height of the side rest (206) is around 22 cm. In some embodiments the left and right side rests (206*a*, 206*b*) are identical, although this is not required in all embodiments. That is, in some embodiments the sides are not identical.

FIG. 2 (E) illustrates a top view of the support pillow (202) showing the view of the top portion of the head rest (204). As shown in FIG. 2(*e*) the headrest (204) portion is configured in curved shape from center towards the top portion (204*a*) within the head rest. It is evident from this figure that the thickness of this portion decreases as the head rest (202) slopes from the center towards the top. The radius of curvature of the headrest rest (204) ranges from 4 cm to 16 cm. In some embodiments the radius of curvature ranges from 5 cm to 14 cm. In some embodiments it ranges from 6 cm to 12 cm. In some embodiments the radius of curvature of the headrest is around 4 cm, 5 cm, 6 cm, 7 cm, 8 cm, 9 cm, 10 cm, 11 cm, 12 cm, 13 cm, 14 cm, 15 cm or 16 cm. In some embodiments the radius of curvature at the superior edge of the headrest is larger than the inferior edge. In this embodiment the radius of curvature at the superior edge or top of the head rest is around 3, cm, 4 cm, 5 cm, 6 cm, 7 cm, 8 cm, 9 cm, 10 cm, 11 cm, 12 cm, 13 cm, 14 cm, 15 cm, or 16 cm. In some embodiments the radius of curvature at the inferior edge or bottom of the head rest is from around 2 cm to around 12 cm, or from around 3 cm to around 10 cm, or from around 4 to 8 cm. In some to embodiments, the radius of curvature at the inferior edge or bottom of the headrest is around 2 cm, 2.5 cm, 3 cm, 3.5 cm, 4 cm, 4.5, cm, 5 cm, 5.5 cm, 6 cm, 6.5 cm, 7 cm, 7.5 cm, 8 cm, 8.5 cm, 9 cm, 9.5 cm, 10 cm, 10.5 cm, 11 cm, 11.5 cm or 12 cm. 4 An acceptable average radius of curvature is 7.5 cm. In some embodiments the radius of curvature is from 2.5 to 6.25 cm, i.e. the diameter is 5 to 12.5 cm.

FIG. 2 (F) illustrates a bottom view of support pillow (202) showing the bottom view of headrest (204). The region from the central portion of the hole to the lower portion of the arch shape bottom portion (204*c*) is carved for accommodating neck of the user in proper alignment, while the user reclines their head during resting.

Figure 3:
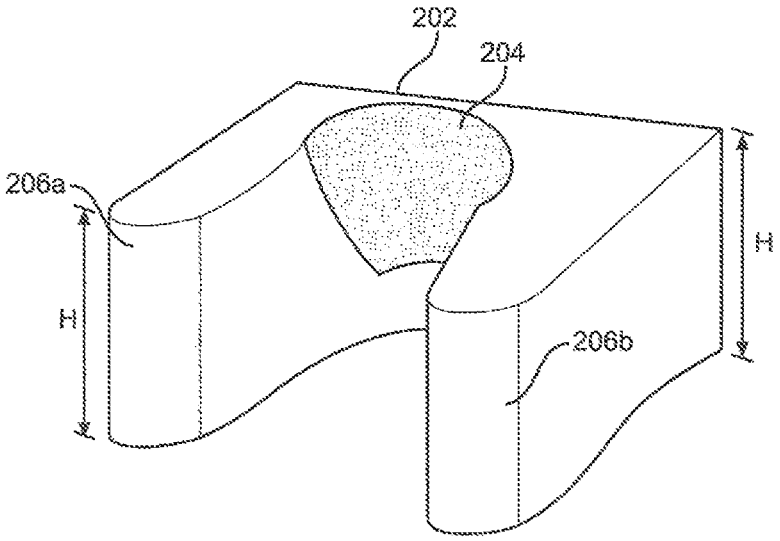
FIG. 3 illustrates a support pillow having tapered sides in which the back is longer than the front.

FIG. 3 illustrates an alternative configuration of the support pillow (202). In this embodiment the support pillow comprises tapered sides in which the front of the support pillow is shorter than the back of the support pillow. Such a configuration finds use when space may be limited for the traveler, such as when the pillow must fit underneath existing head supports as are commonly found on airplane seat backs, and the smaller profile of the pillow may be beneficial. For instance, as exemplified in the figure, the back of the support pillow may be around 14-20 cm, more preferably 16-18 cm, more preferably 18 cm high, while the front of the support pillow may be around 10-15 cm, more preferably 12-14 cm, or more preferably 14 cm high. In some embodiments, the height of the front of the support pillow is 5%, 10%, 15%, 20%, 25% or 30% shorter than the height of the back of the support pillow.

Figure 4:
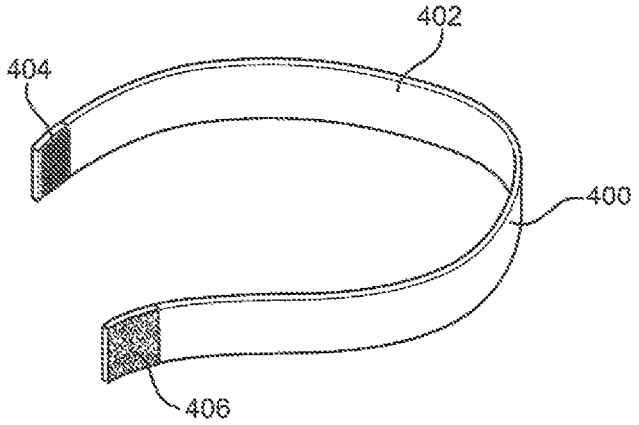
FIG. 4 illustrates a strap of the support pillow in accordance with the present invention.

FIG. 4 illustrates a strap 402 of the support pillow assembly 500 (see FIG. 5) in accordance with the present invention. In this embodiment, a strap (402) is provided for holding the support pillow (102) in place with the head. The strap (402) may engage with the support pillow (102) in a variety of configurations. Considering the support pillow in FIG. 1, the strap (402) may be placed at bottom of the support pillow (102) for supporting the support pillow (102) in place relative to the head of the user. In one configuration the strap (402) is extended in front of the neck starting from one side rest (106) to the other side rest (106).

The strap (400) may be made of elastic material, which is stretchable enough to accommodate the neck of the user. Moreover, the strap (400) provides the support necessary to keep the head rest in place relative to the head of the user. Furthermore, the strap may be made of elastic cotton material. In other embodiments, the strap also may be a belt that supports the support pillow (102) in place relative to the head of the user. In one embodiment of the present invention, the width of the strap ranges from around 4.5 cm to 6 cm. More particularly, the width of the strap is around 4.5 cm, which secures the support pillow (102) in place relative to the head of the user.

The strap (400) comprises a central component (402), which may be made of a variety of materials, and a connector with a male member (404) and a female member (406) to secure one side of the central component (402) to the other. Primarily, the connector is made of Velcro® hook and loop assembly, connectors with a male and a female member. Alternatively, the connector may be a button, hooks, magnets and/or buckles to connect the strap (400) ends together.

Figure 5:
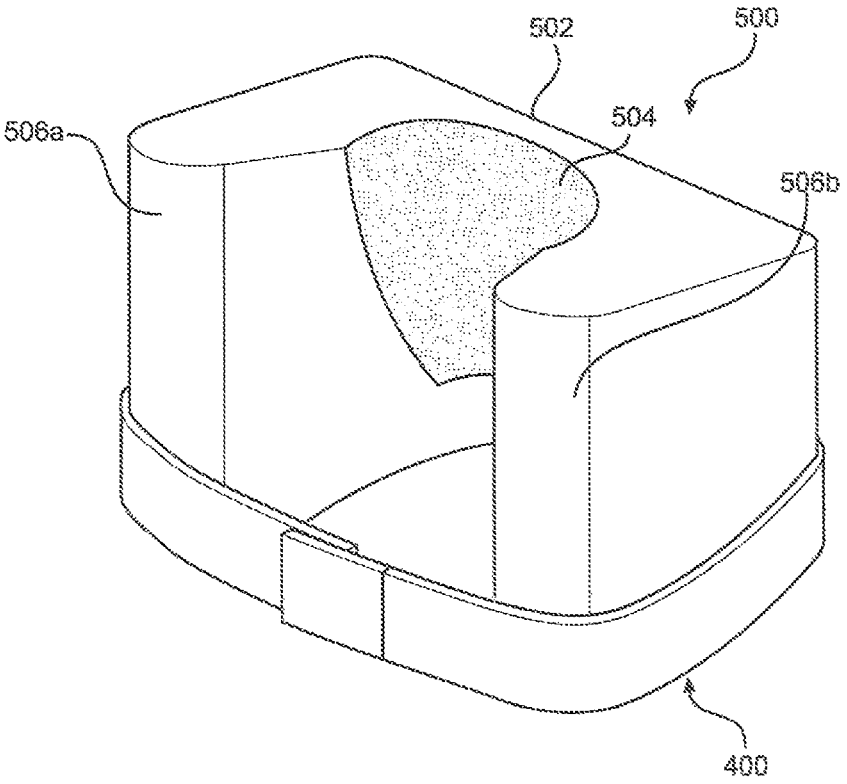
FIG. 5 illustrates a perspective view of the support pillow assembly.

FIG. 5 illustrates a perspective view of the support pillow assembly (500). In accordance of the present invention, the support pillow assembly (500) comprises a support pillow (502) configured to support the neck and/or head of a user, in supine, in reclined, or in erect position. The support pillow (502) also provides vertical and lateral support to the head of the user. The support pillow (502) further comprises a head rest (504) and a pair of side rests (506) that in some embodiments may be identical with each other, and that are configured to cover the left and right side of the user's head. Each side rest (506*a*, 506*b*) is configured to cover the left side and right side of the user's head, from shoulder to the top of the head. The side rests (506*a*, 506*b*) may be sized such that the user's ears do not contact the support pillow when the head is at least in the center forward facing position.

The headrest (504) of the support pillow further is concavely recessed between the pair of side rests (106) for supporting the back portion of the head. The head rest (504) is depressed inwards, to align the head and neck of the user in the forward-facing position, when the user is resting or sleeping during travelling. The head rest (504) of the support pillow (502) further includes a top portion, a central portion and a bottom portion.

The top portion of the head rest (504) of the support pillow (502) supports the posterior part or top portion of the head of the user. In one embodiment of the present invention, the top portion of the head rest (504) is tapered for accommodating head in proper alignment, while the user reclines their head during resting. The central portion of the head rest (504) of the support pillow (502) supports the middle posterior (occipital) portion of the head. In some embodiments, the central portion further comprises a hole for supporting the occiput part of the head.

The bottom portion of the support pillow (502) is shaped into arcuate form for resting the support pillow (502) on the shoulder of the user, so as to remain in position without falling off the shoulder. In one embodiment of the present invention, the top of the arc-shape bottom portion is at the base of the back rest (504) and bottom of the same lie at the base of the side rest (506*a*, 506*b*) of the support pillow (502) and is arched toward the front of the user such that the bottom of the sides rest on the shoulder and chest of the user.

In some embodiments the support pillow assembly (500) further comprises a strap (400) that is placed at bottom of the support pillow (502) for supporting the support pillow (502) in place relative to the head of the user. The strap (400) may be configured to wrap in front of the neck of the user starting from one of the side rest (506*a*) to connect with another side rest (506*b*). Alternatively, the strap (400) may wrap around the support pillow and in some embodiments may rest against the back of the neck of the user. The strap (400) is preferably used for holding the support pillow (502) to the user in various support configurations. The strap (400) is preferably made of a durable and elastic material that conforms around the neck of the user easily. The length of the strap (400) may be adjusted depending on size and shape of the head and neck of the user.

The optional strap (400) further includes a male member and a female member that can be joined by using a connector to secure one side of the strap (400) to the other side of the same. In one embodiment, the connector is a Velcro® hook and loop assembly type connection. In other embodiment, the connector may be of button, magnet, hook and/or loop connectors, or other separable fasteners to enable attachment for properly holding the pillow at varying orientations.

The support pillow assembly (500) includes a support pillow (502), that is made up of a single piece foam material. The single piece foam material is designed and configured in a way to form a head and neck supporting portion of the support pillow (502). Primarily, the single piece support pillow (502) includes a pair of side rests (506) on each side of a head rest (504), the side rests (506) are angled upwards with respect to the head rest (504), for supporting the left and right portions of the head. The thickness of each side rest symmetrically reduces towards the head rest (504) of the support pillow (502). Alternatively, the single piece support pillow (502) includes a pair of side rests (506) on each side of a head rest (504). In some embodiments the pair of side rests (506) are not identical.

The support pillow assembly in some embodiments (500) further includes a strap (400) placed at bottom of the support pillow (502), wherein the strap (400) is wrapped from one of the side rests to the other side rest (506).

In one embodiment of the present invention, the support pillow (502) of the support pillow assembly (500) is made up of a conformable foam material that conforms to the shape of head, neck and shoulder of the user, and this support provides additional comfort and stability on the shoulder. In some embodiments the support pillow (502) is constructed wholly or in part from a memory foam, Topi-Foam® or visco-elastic foam. In alternative embodiment, the foam is either a polyurethane foam or latex foam. In some embodiments of the support pillow, there may be a thin coating applied as the exterior layer of the pillow, and/or any of its accompanying storage, cover, strap, utility collapse mechanism, rigid support surfaces, for ease of cleaning for pathogens or general grime.

In alternative embodiment, the support pillow (502) may also be provided with a removable cover or case, to protect the pillow and may be removed for cleaning or replacement thereof. The removable cover may be designed as per the dimensions and design of the support pillow (502). The cover of the support pillow (502) is fabricated primarily of a soft fabric, such as fleece or cotton. Other materials may be used depending upon environmental considerations, pathogen remediation such as virus or bacteria, or user preferences.

Figure 6:
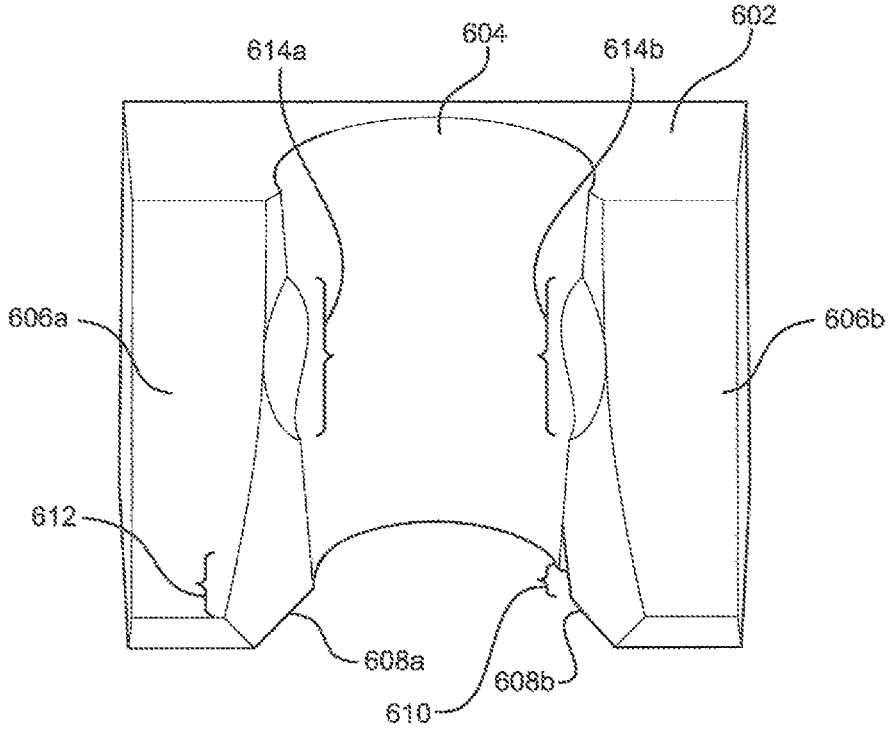
FIG. 6 depicts a front view of the portable, support pillow described herein.

Turning to FIG. 6, the present disclosure also provides a pillow (602) configured to fold in on itself to facilitate storage. In this embodiment, the pillow may be comprised of a single, unitary body comprising a right (606*a*) and a left side (606*b*) as well as a central portion (604) configured to receive the head and neck of a user. The bottom of each of the right (608*a*) and left (608*b*) sides is curved beginning at the back of the pillow and extending over the user's shoulders downward toward their chest as previously described herein. In addition, the pillow comprises additional features including a notch (610), which can be on the bottom of either of the right or left side. It is depicted on the bottom of the left side in FIG. 6. As noted previously the pillow is collapsible such that one of the sides folds to the opposite. The notch (610) receives the front, interior edge of the side being folded. For instance, in FIG. 6 the front, interior right edge (612) once folded, is inserted into the notch (610) on the left side. In some embodiments the pillow has a notch on each of the right and left sides capable of receiving the front, interior edge of either the left or right side, respectively.

Additional features shown in FIG. 6 include indentations on the right (614*a*) and left (614*b*) side of the pillow. The indentations are configured to receive the user's ears allowing the ears to be positioned comfortably against the sides of the pillow.

Figure 7:
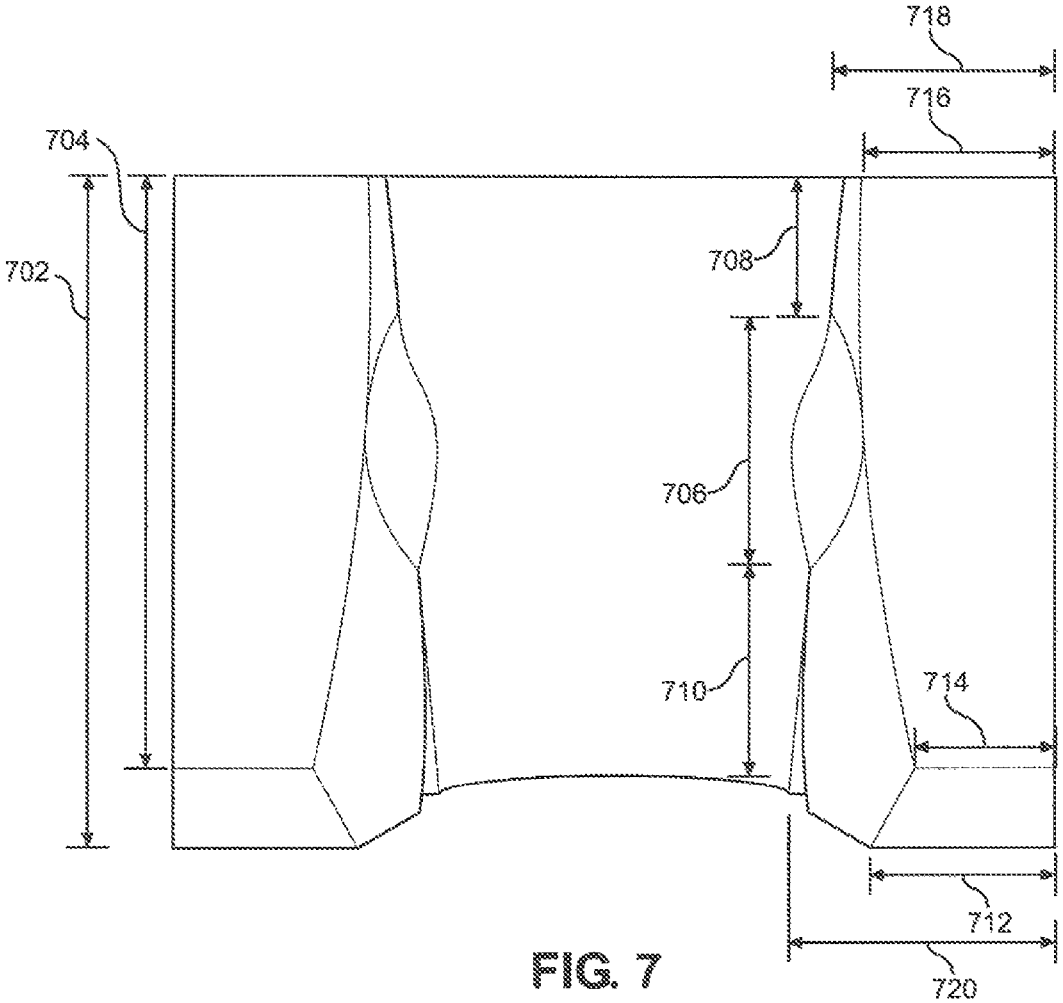
FIG. 7 depicts a front view of the portable, support pillow described herein.

In FIG. 7 additional details about the potentially-collapsible pillow are described.

Exemplary dimensions include a maximum height (702) of 8.75 inches, a height from the top of the pillow to the posterior most edge (704) of 7.75 inches. An exemplary height of the ear recesses (706) is 3.42 inches. An exemplary height from the inferior posterior edge of the pillow to the bottom of the ear recess (710) is 2.67 inches. Exemplary length from the lateral edge of the side rest to the anterior most edge of the front of the side rest (714) is 1.78 inches. An exemplary length from the lateral edge of the side rest to the anterior most edge on the inferior side of the pillow (712) is 2.35 inches. Exemplary length from the lateral edge of the pillow to the anterior, superior most edge of the side rest (716) is 2.53 inches. Exemplary length from the lateral edge of the pillow to the anterior, superior edge of the headrest (718) is 2.79 inches. The length from the lateral edge of the pillow to the inferior, anterior edge of the headrest (720) is 3.43 inches. While specific dimensions are set forth herein, it is appreciated that each of the dimensions may be increased or decreased by 1%, 2%, 3%, 4%, 5%, 6%, 7%, 8%, 9%, 10%, 15%, 20%, 25%, 30%, 35%, 40%, 45% or 50%.

Figure 8:
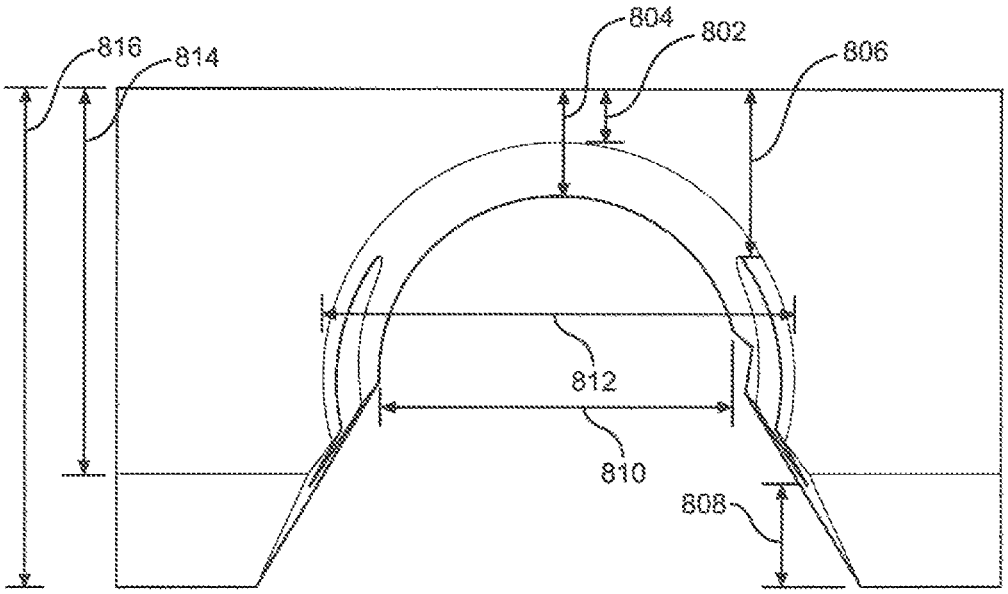
FIG. 8 depicts a top view of the portable, support pillow described herein.

In FIG. 8 additional details about the potentially-collapsible pillow are described. FIG. 8 is a superior view of the pillow. Exemplary dimensions include a width from the posterior of the pillow to the superior, posterior edge of the top of the head rest (802) is 0.67 inches, the width from the posterior of the pillow to the inferior, posterior edge of the bottom of the head rest (804) is 1.39 inches. The width from the posterior of the pillow to the posterior most edge of the ear recess (806) is 2.28 inches. The width from the anterior most edge of the pillow to the anterior most edge of the ear recess (808) is 1.34 inches. The diameter of the inferior curved headrest region (810) is 4.65 inches. The diameter of the superior curved headrest region (812) is 6.16 inches. The width of the superior edge of the pillow from the posterior edge to the anterior most edge (814) is 5 inches. The width of the pillow from the posterior edge to the anterior most edge (816) is 6.5 inches. While specific dimensions are set forth herein it is appreciated that each of the dimensions may be increased or decreased by 1%, 2%, 3%, 4%, 5%, 6%, 7%, 8%, 9%, 10%, 15%, 20%, 25%, 30%, 35%, 40%, 45% or 50%. In some embodiments the pillow may have larger horizontal and vertical dimensions while still preserving the specified head recess dimensions. The head-supporting lateral sides of the pillow can range in width (from exterior to interior of the side) from the specified 2¾ inches to 7 inches for uses requiring less portability.

Figure 9:
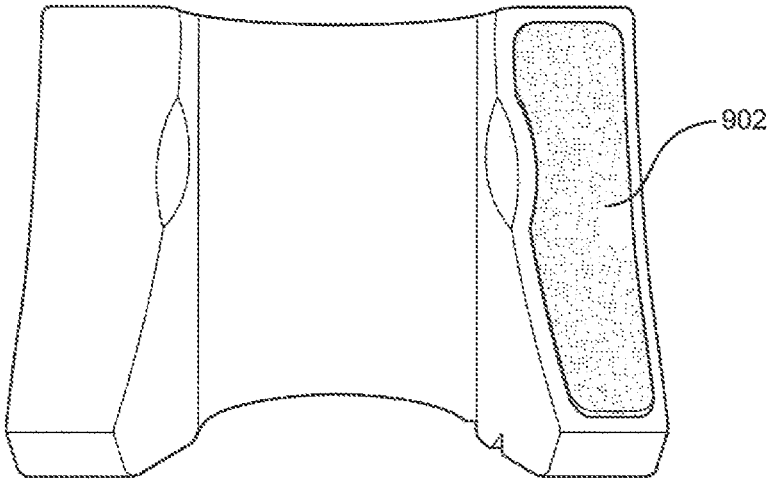
FIG. 9 depicts a front view of the portable, support pillow described herein, including front rigid support.
Figure 10:
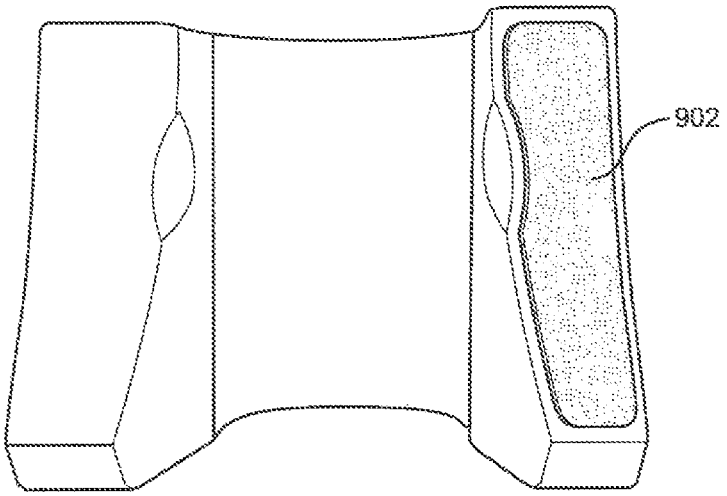
FIG. 10 depicts a front view of the portable, support pillow described herein, including front rigid support.

FIG. 9 and FIG. 10 provide additional detail about the collapsible pillow. As can be seen on the front of the left side is a hard surface (902) attached to the pillow. This hard surface may be made of plastic, metal, wood or any other rigid material and may be covered with rubber or another, possibly synthetic, material with a rough or tacky texture. In some embodiments the plastic may be made from biodegradable plastic such as poly-lactic acid (PLA). This hard panel may be on the left, right, or both anterior facets of the head rests.

The purpose of the rigid surface is to form a segment of a rigid front of the collapsed pillow as further described herein, both to provide firmness when softer foam is used, as well as to provide a hard surface which when folded aligns on its inner aspect with the rigid surface depicted in FIG. 11 and described below, allowing even distribution of forces onto the foam to facilitate compression against another hard surface on the back of the pillow which when secured with a Velcro® hook and loop assembly, tab-in-slot, or other similar ratchet mechanism, or into a case elsewhere described, creates a thinner and more portable configuration. The hard surface may cover 75%, 80%, 85%, 90%, 95%, 96%, 97%, 98%, 99% or 100% of the surface to which it is attached. In some embodiments the central portion comprises a hole as described herein but in some embodiments it does not. When used with a solid back to facilitate storage collapsing of the pillow, there may be no need for the hole.

Figure 11:
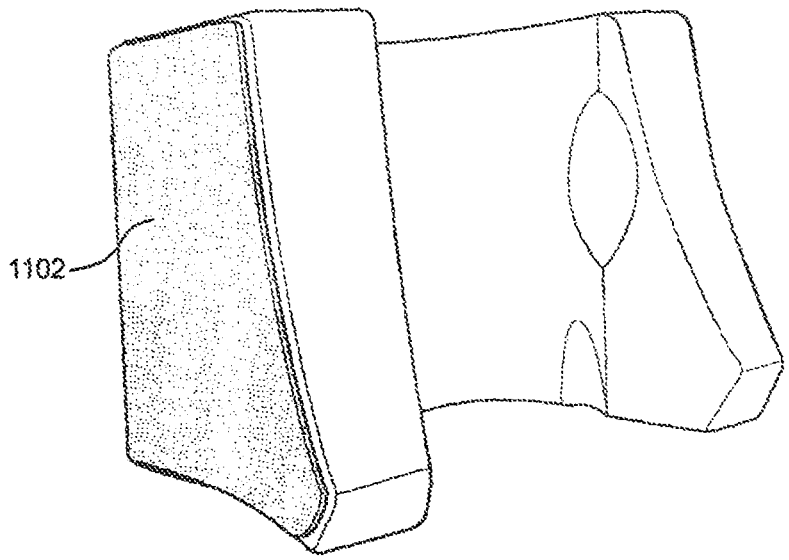
FIG. 11 depicts a perspective view of the portable, support pillow described herein, including side rigid support.

FIG. 11 depicts a side view of the pillow. As can be seen on the right side of the pillow is a hard surface (1102) attached to the pillow. This hard surface may be placed on the right or left side of the pillow and may be made of plastic, metal, wood, poly-lactic acid (PLA) or any other rigid material. and may be covered with rubber or another, possibly synthetic, material with a rough or tacky texture whose purpose is to decrease sliding of the pillow against any abutting surface. The purpose of the rigid surface is both to provide firmness when softer foam is used, as well as to provide a hard surface which when folded aligns on its inner aspect with the rigid surface depicted in FIG. 10 and described above, allowing even distribution of forces onto the foam to facilitate compression against another hard surface on the back of the pillow which when secured with a magnet, Velcro® hook and loop assembly, tab-in-slot, buckle, or other "ratchet" mechanism, or into a case elsewhere described, creates a thinner and more portable configuration. The hard surface may cover 75%, 80%, 85%, 90%, 95%, 96%, 97%, 98%, 99% Or 100% of the surface to which it is attached.

Figure 12:
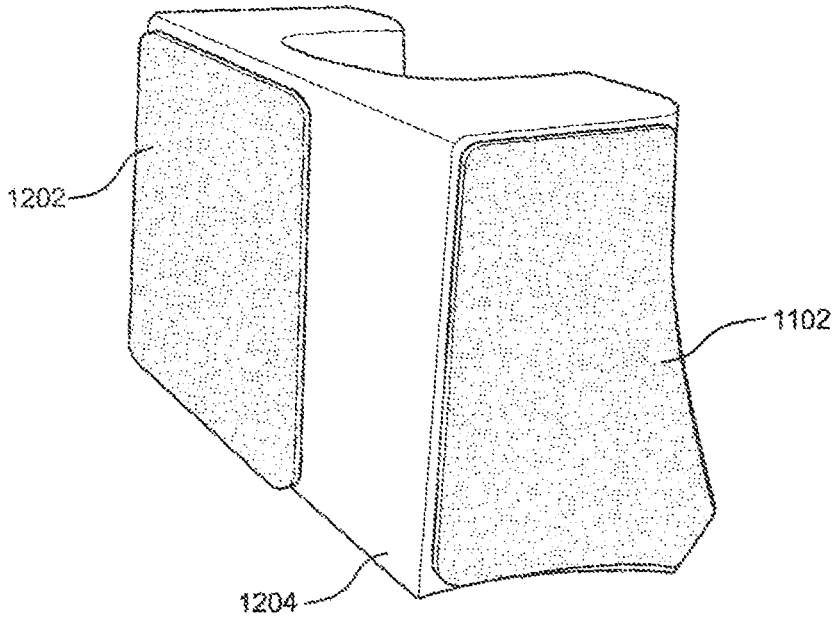
FIG. 12 depicts a perspective view of the portable, support pillow described herein, including back rigid support.

FIG. 12 depicts a rear view of the pillow. As can be seen, a hard surface (1202) also is attached to the rear of the pillow. This hard surface may be made of plastic, metal, wood or any other rigid material such as poly-lactic acid (PLA) and may be covered with rubber or another, possibly synthetic, material with a rough or tacky texture whose purpose is to decrease sliding of the pillow against any abutting surface. The purpose of the rigid surface is both to provide firmness when softer foam is used, as well as to provide a hard surface which when folded allows even distribution of forces onto the foam to facilitate compression against the two aligned hard surfaces on the front of the folded pillow which when secured with a Velcro® hook and loop assembly, tab-in-slot, or other similar ratchet mechanism, or into a case elsewhere described, creates a thinner and more portable configuration. The hard surface may cover from 20% to 80% of the back of the pillow, or in some embodiments from 45% to 75% of the back of the pillow. In some embodiments the hard surface may cover 20%, 30%, 40%, 50%, 60%, 65%, 70%, 75%, 80%, 85%, 90%, 95%, 96%, 97%, 98%, 99% Or 100% of the back pillow surface to which it is attached. When the back hard surface (1202) covers less than 100% of the back of the pillow, it may be placed predominantly on the left or right side of the back of the pillow. In such cases it is generally aligned with the edge on the same side as notch (610). Thus, the uncovered portion of the back of the pillow (1204) is on the same side as side having the hard surface (1102) attached. The uncovered portion of the pillow provides flexibility of the pillow allowing the side to be folded forward to collapse the pillow.

In one embodiment the support pillow comprises a rigid back on the posterior side of the pillow. The rigid back may be made of cardboard, plastic, metal or other material capable of providing rigidity and/or support for the user. In addition, the rigid back finds a dual purpose as a component of a storage container as further outlined herein. In some embodiment the rigid back is made of plastic, composite, pressboard, laminate, or other similar hard material of thickness between 2 and 6 mm, preferably between 3 and 5 mm, lying on the posterior surface of the pillow or integrated within that facet of the pillow, of height measuring one hundred percent of the height of the pillow, and of length measuring between thirty percent to one hundred percent of the length of the pillow and either centered evenly about the midline of the pillow or placed only along either the right or left aspect of the posterior surface of the pillow and measuring between thirty percent and eighty percent, and preferably between sixty percent and eighty percent of the length of the pillow; and height one hundred percent of the height of the pillow. In embodiments where the rigid back occupies one hundred percent of the posterior surface of the pillow the rigid surface may have a crimp, also sometimes termed a "living hinge," or actual hinge where the hard material is able to partially or fully fold along a line which lies to the left or right of the midline of the pillow from 20 to 60 percent of the distance from the midline to the lateral edge of the pillow. In embodiments with a hard surface on the side of one side rest, this hinge or crimp lies toward the side rest whose lateral surface is also covered with the hard surface.

In one embodiment the rigid back is made of plastic, composite, pressboard, laminate, or other similar hard material of thickness between 2 and 6 mm, preferably between 3 and 5 mm, lying on the anterior surface of one or both, preferably one, of the side-supporting headrest portion of the pillow or integrated within that facet of the pillow, of height measuring between one hundred percent and eighty percent, preferably one hundred percent, of the height of the pillow, and of length measuring one hundred percent of the length of the pillow and either centered evenly about the midline of the pillow or placed only along either the right or left aspect of the posterior surface of the pillow and measuring between thirty percent and eighty percent, and preferably between sixty percent and eighty percent of the length of the pillow; and height one hundred percent of the height of the pillow.

Figure 13A:
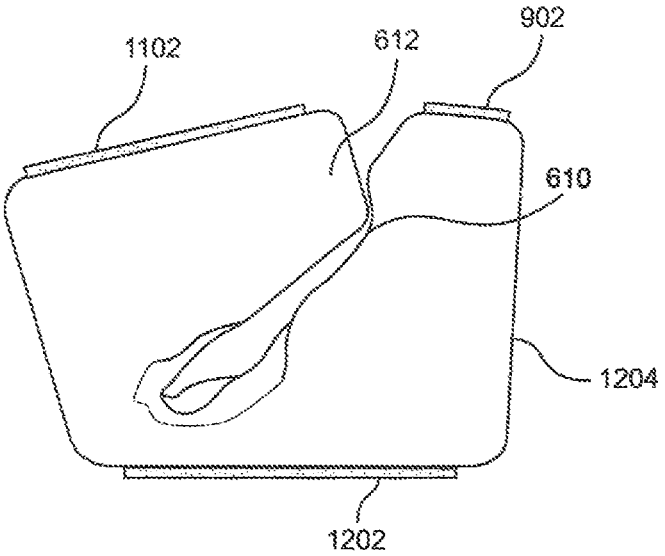
FIG. 13 (A) depicts an inferior view of the folded support pillow described herein.

In some embodiments, as shown in FIG. 13(A), the side of the pillow having the hard surface (1102) is folded forward and toward and toward the opposite side of the pillow forming a collapsed support pillow. Edge (612) fits into notch (610), forming a hard or rigid front cover of the pillow. The back hard surface (1202) forms the back rigid cover of the pillow. The uncovered back of the pillow (1204) is now positioned on the side of the collapsed pillow, leaving the left and right sides exposed pillow material. This has the advantage of being flexible or compressible, which allows for further reduction in size of the collapsed pillow. In some embodiments the collapsed pillow may be compressed by 5% to 75% its original collapsed size, or from 10% to 60% of its original collapsed size, or from 20% to 50% of its original collapsed size. In some embodiments it compressed by 5%, 10%, 15%, 20%, 25%, 30%, 35%, 40%, 45%, or 50% its original collapsed size.

Figure 13B:
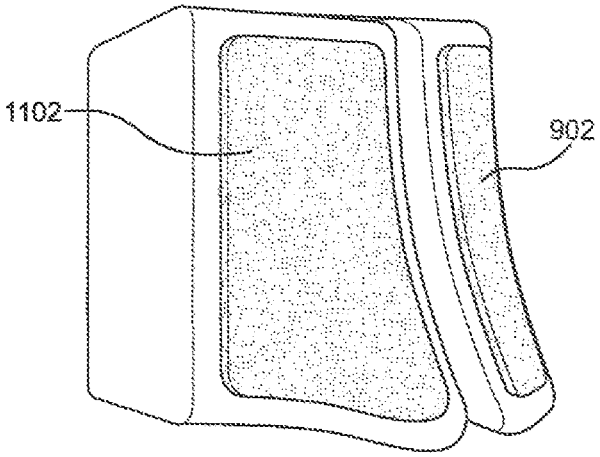
Figure 13C:
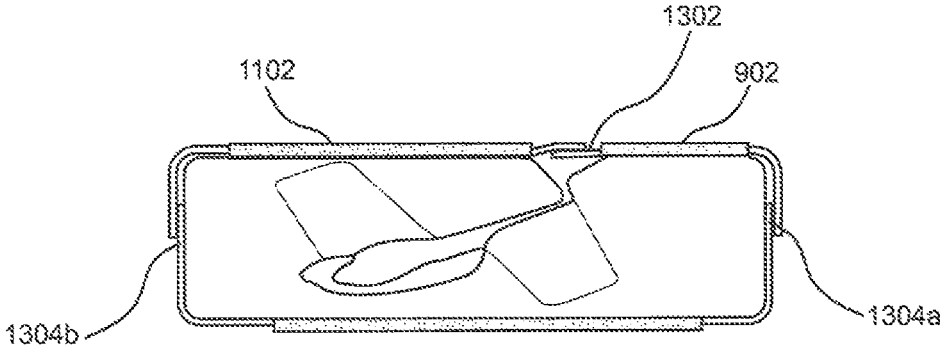

FIG. 13(B) shows a perspective view of the front of the collapsed support pillow depicting how the side hard shell (1102) meets with front hard shell (902) to form a solid front of the collapsed support pillow.

FIG. 13 (C) shows an inferior view of the folded and compressed support pillow. Side (1102) folds adjacent to front hard surface (902) leaving soft, compressible sides. The compressed pillow may be locked with an anterior locking mechanism (1302). The anterior locking mechanism may be may be comprised of straps, buckles, ties, Velcro® hook and loop assembly, ratchet system, and the like. In addition, the compressed support pillow may also comprise lateral locking mechanisms (1304*a* and 1304*b*) to facilitate maintaining the compressed pillow in compressed configuration. The lateral locking mechanisms may be comprised of straps, buckles, ties, Velcro® hook and loop assembly, ratchet system, and the like.

Figure 13D:
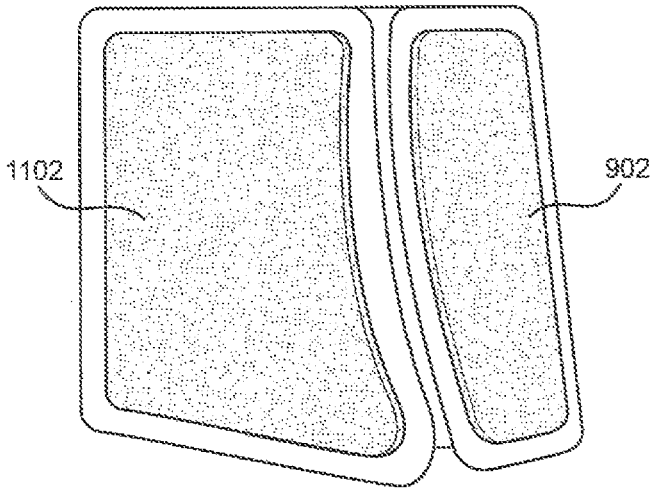
Figure 13E:
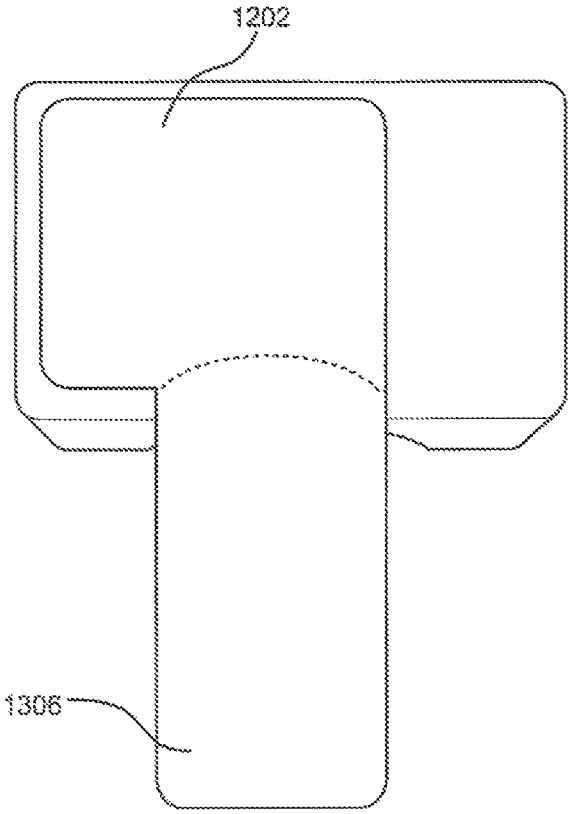
Figure 13F:
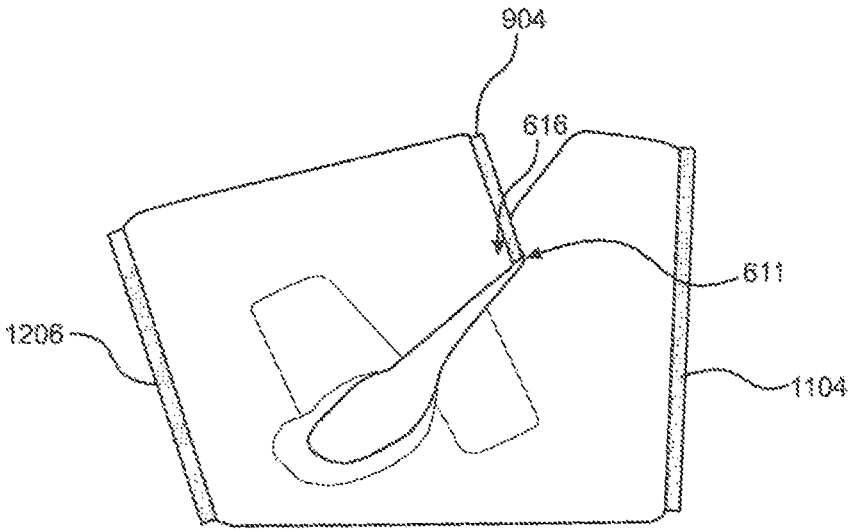
Figure 13G:
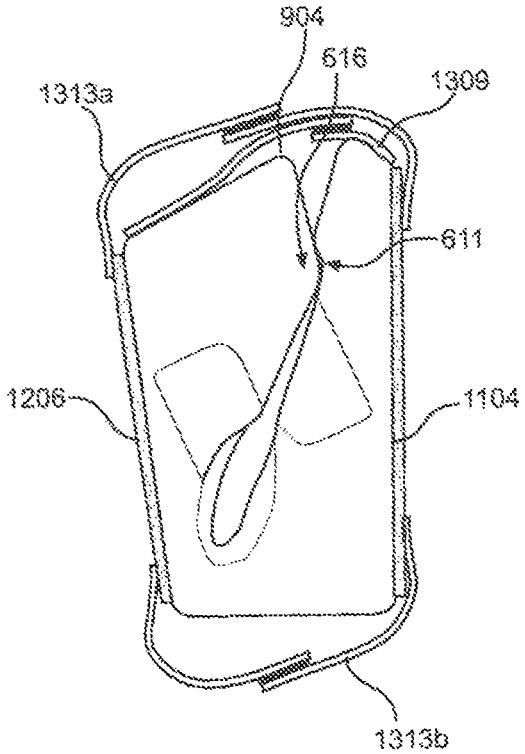

FIG. 13(D) depicts a front view of the folded or compressed pillow. Rigid supports (1102) and (902) form the front of the collapsed pillow.

In some embodiments the pillow is folded and compressed from side-to-side rather than front-to-back as above. This folded configuration has the advantage of greater ease of compression since the same force compresses a smaller surface area, and the compressed pillow can have smaller overall dimensions as compared to the front-to-back compression embodiment. FIG. 13 (F) shows an inferior view of this alternative configuration of the folded and compressed support pillow as it is compressed in the side-to-side dimension. In this embodiment the hard surface on the back of the pillow (1206) occupies around 37.5 percent of the back of the pillow and the head rest opposite to the side on which this hard surface lies has a hard surface (1104) occupying 80 to 100% of its lateral aspect. The front of the head rest on the same side as the 37.5% of the back portion with the rigid support has a rigid support (904) occupying 80 to 100% of its surface. Edge (616) fits into notch (611), leaving the front and back of the pillow soft and compressible. The compressed pillow may be locked with an anterior locking mechanism (1309). The anterior locking mechanism may be may be comprised of straps, buckles, ties, Velcro® hook and loop assembly, ratchet system, and the like. In addition, as shown in FIG. 13 (G), the compressed support pillow may also comprise an additional anterior and a posterior locking mechanism (1313*a* and 1313*b*) to facilitate maintaining the compressed pillow in compressed configuration. The anterior and posterior locking mechanisms may be comprised of straps, buckles, ties, Velcro® hook and loop assembly, ratchet system, and the like.

In some embodiments the support pillow comprises an extendable rigid panel that extends below the bottom of the posterior of the pillow. FIG. 13 (E) depicts a posterior view of the support pillow showing a sliding back plate (1306) in extended position. When not extended the sliding back plate (1306) slides inside the rigid back plate (1202). In some embodiments the back plate may be attached to the support pillow or back plate with a hinge and fold down rather than slide. The extendable plate may be made of plastic, metal, wood, poly-lactic acid (PLA) or any other rigid material. and may be covered with rubber or another, possibly synthetic, material with a rough or tacky texture whose purpose is to decrease sliding of the pillow against any abutting surface.

In some embodiments the height of the extendable panel is from around 10 cm to around 40 cm. The extendable panel may be 75%, 80%, 85%, 90%, 95%, 96%, 97%, 98%, 99% or 100% of the size of the rigid back plate (1202). In some embodiments the extendable panel is 50%, 60%, 70%, 75%, 80%, 85%, 90%, 95%, 96%, 97%, 98%, 99% or 100% of the width of the rigid back plate (1202).

Figure 14:
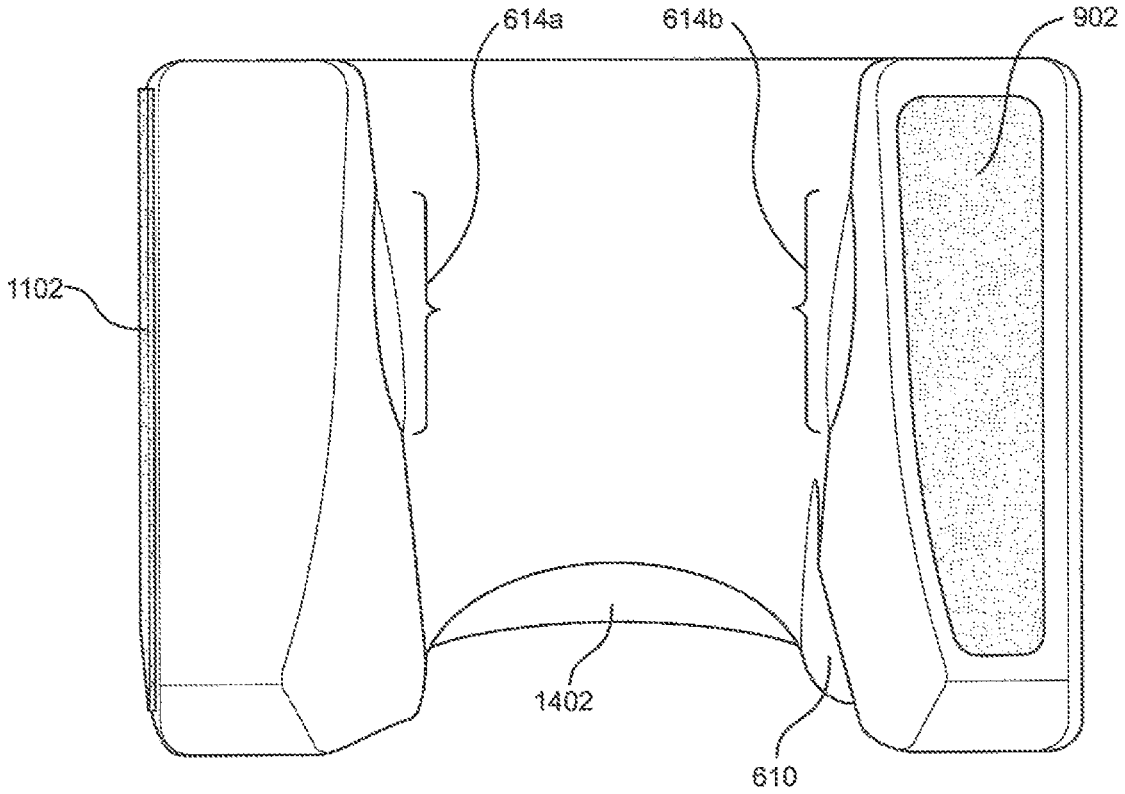
FIG. 14 depicts a front view of the support pillow.

FIG. 14 depicts a front view of the open pillow showing the notch (610), ear cavities (614(*a*)) and (614(*b*)) as well as the front rigid plate (902) and side or lateral rigid plate (1102). In addition, a curved section between the side and below the head rest is apparent (1402). In some embodiments a similar contoured or curved region is found at the top of the head rest in which the top is curved from back to front. In some embodiments the top curvature and bottom curvature parallel each other. In some embodiments the front contour of the sides is flat, although in some embodiments it is curved as outlined herein.

Figure 15:
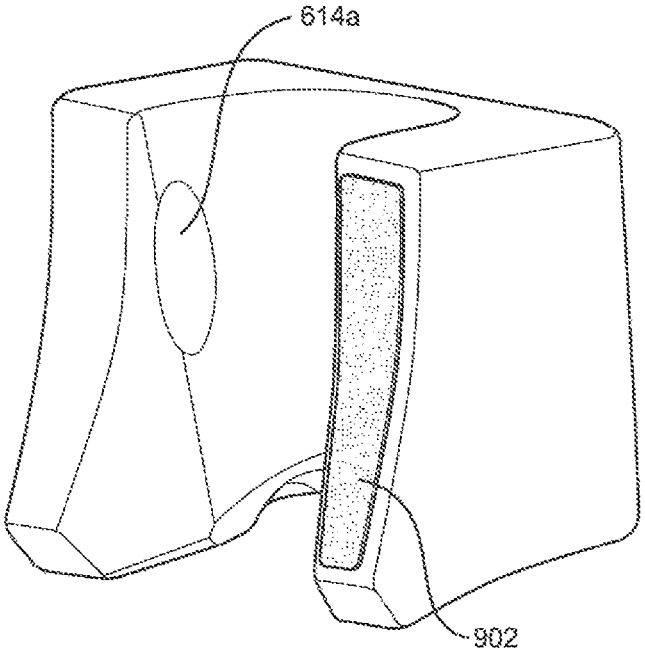
FIG. 15 depicts a front, perspective view of the support pillow.

FIG. 15 depicts a perspective view of the support pillow showing the front plate (902) and ear cavity (614(*a*)).

Figure 16:
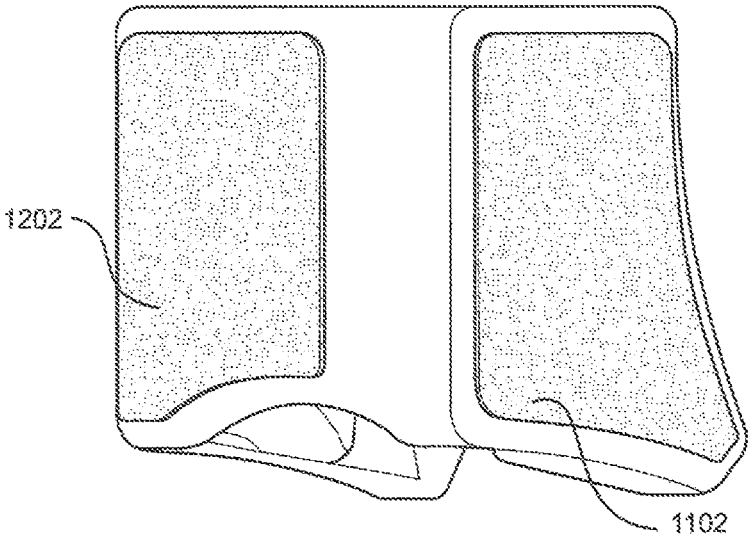
FIG. 16 depicts a rear, perspective view of the support pillow.

FIG. 16 depicts a rear perspective view of the travel pillow showing the side or lateral rigid support (1102) as well as the posterior rigid support (1202).

Figure 17A:
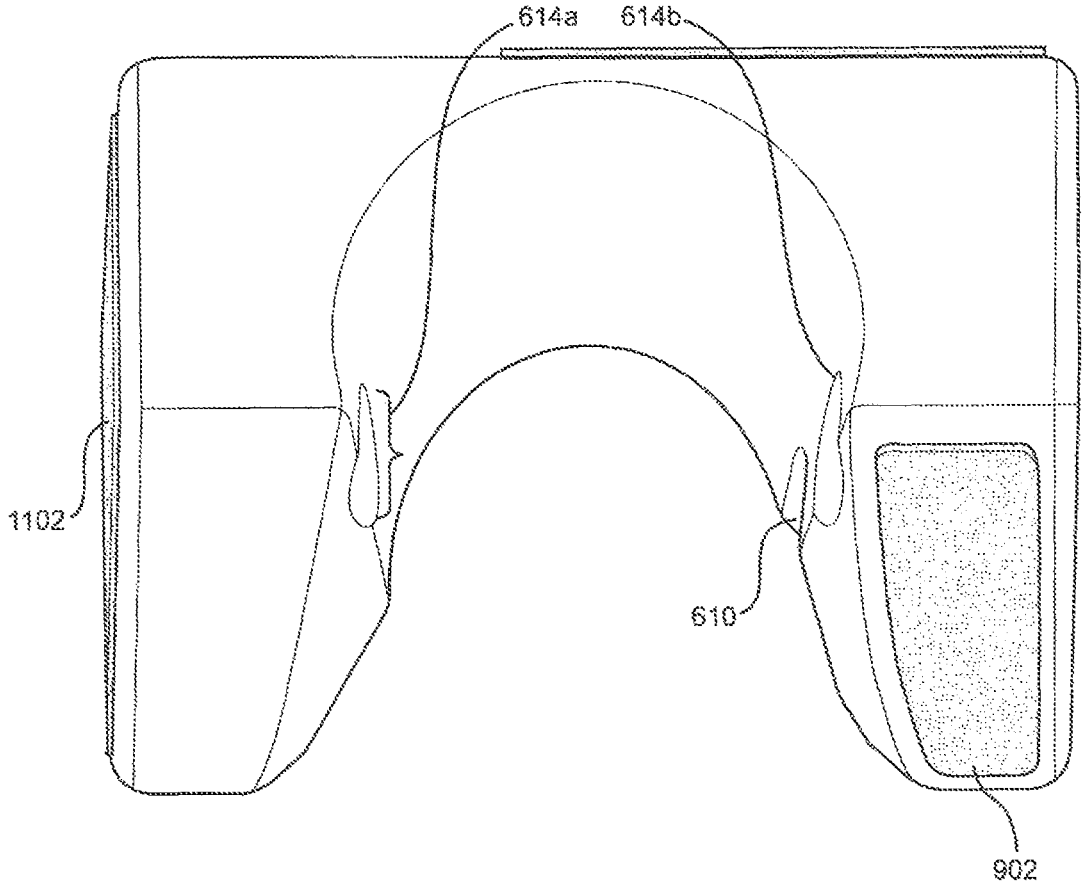
FIG. 17(A) and FIG. 17(B) depict a top view of the support pillow.

FIG. 17(A) depicts a top perspective view of the support pillow showing lateral rigid support (1102), front rigid support (902), ear cavities (614(*a*)) and (614(*b*)) as well as notch (610).

Figure 17B:
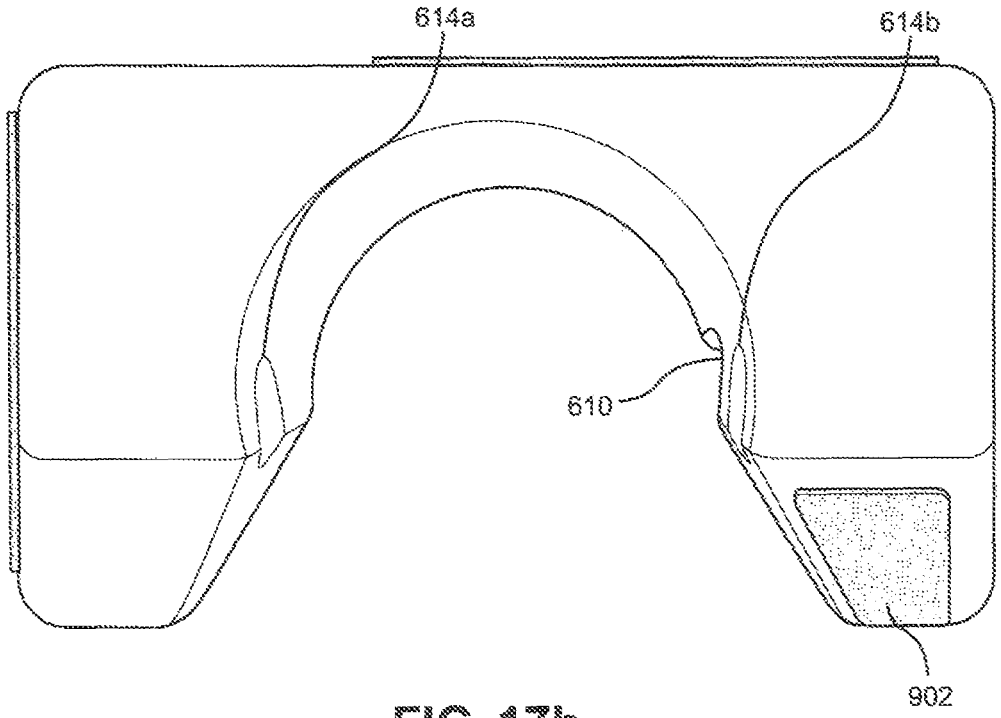

FIG. 17(B) depicts a top view of the support pillow showing front rigid support (902), ear cavities (614(*a*)) and (614(*b*)) as well as notch (610).

Figure 18:
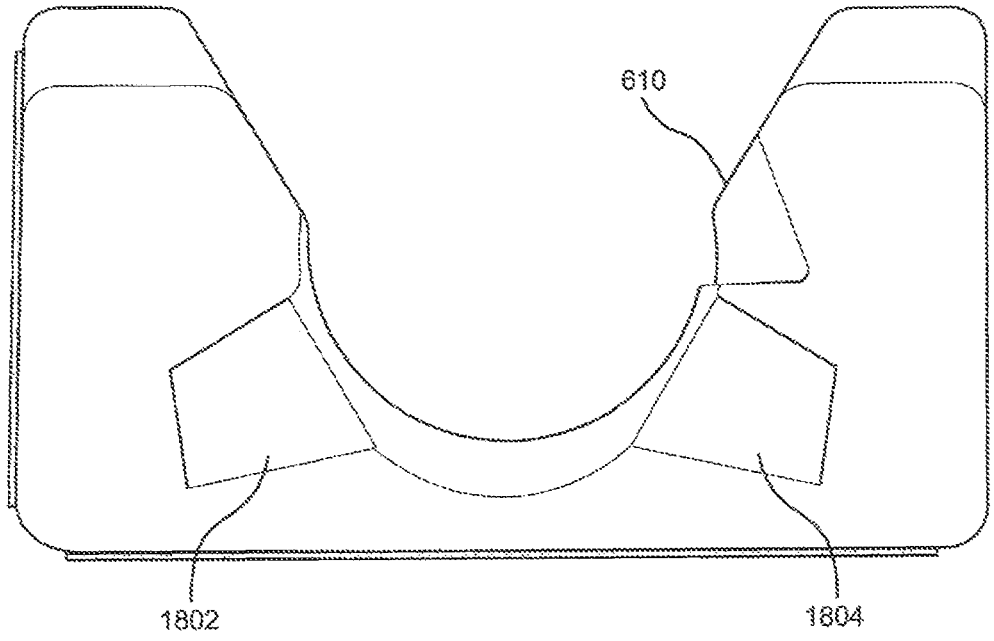
FIG. 18 depicts an inferior view of the support pillow.

FIG. 18 depicts an inferior view of the support pillow showing notch (610) and trapezius recesses (1802 and 1804). The trapezius recesses are configured to rest against and receive the trapezius muscles of the user.

Figure 19:
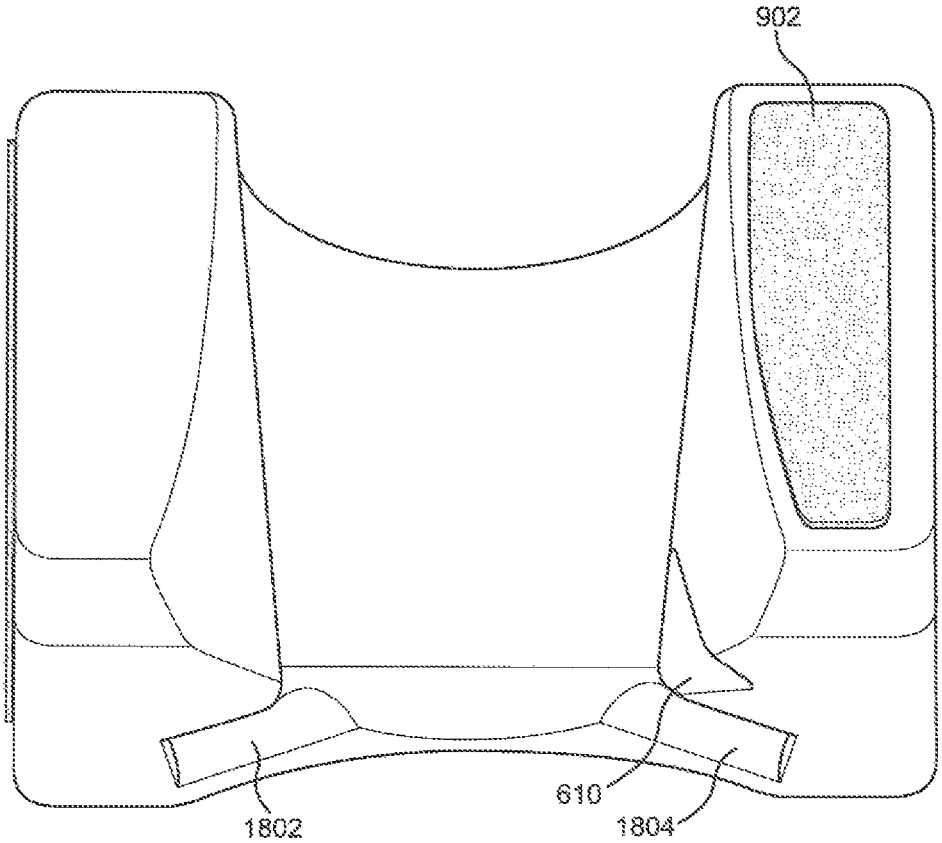
FIG. 19 depicts an inferior, perspective view of the support pillow.

FIG. 19 depicts a perspective inferior view of the support pillow showing notch (610) and trapezius recesses (1802 and 1804). In addition front rigid support (902) is shown.

Figure 20:
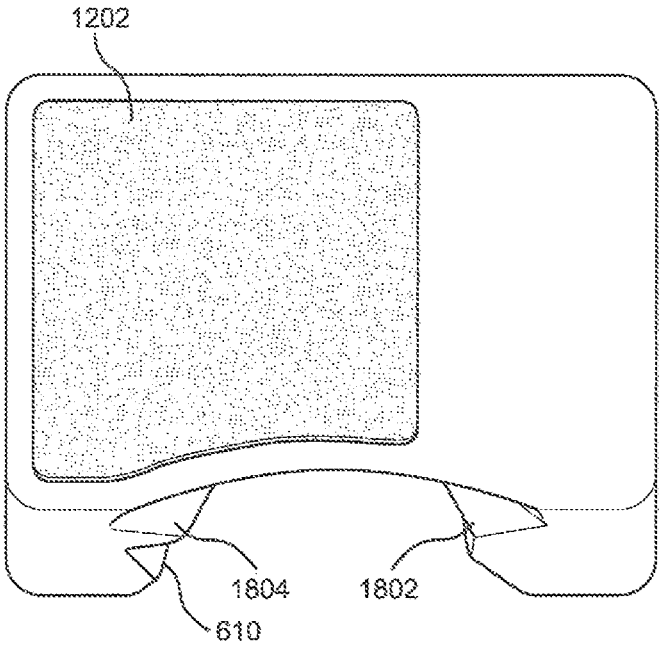
FIG. 20 depicts a rear, perspective view of the support pillow.

FIG. 20 depicts a posterior view of the support pillow showing the posterior rigid support (1202) as well as trapezius recesses (1802 and 1804) as well as notch (610).

Figure 21:
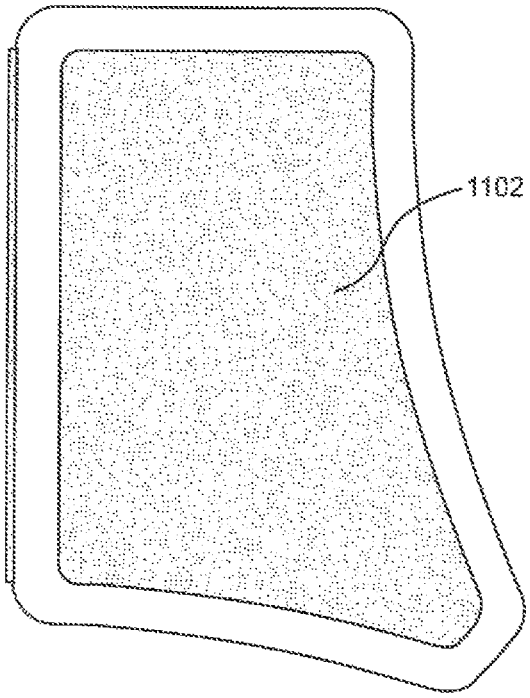
FIG. 21 depicts a lateral view of the support pillow.

FIG. 21 depicts a lateral side of the support pillow with lateral rigid support (1102).

Figure 22:
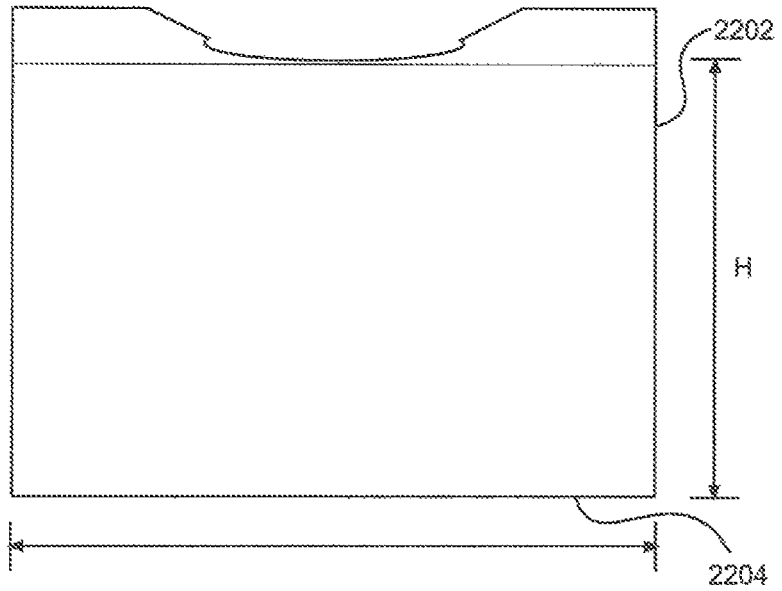
FIG. 22 depicts a rear view of the support pillow.

FIG. 22 depicts the back of the pillow and shows exemplary dimensions of the support pillow in inches. Exemplary dimensions for length and height are shown. In some embodiments the length of the back (2204) of the support pillow is from 10 inches to 15 inches, or from 11 inches to 14 inches, or from 11.25 inches to 12.5 inches. In some embodiments the length of the back (2204) is 10, 10.5, 11, 11.5, 12, 12.5, 13, 13.5, 14 or 14.5 inches. In some embodiments the height of the back (2204) of the support pillow is from 5 inches to 12 inches, or from 6.5 inches to 11 inches, or from 7 inches to 10 inches, or from 7.5 inches to 9 inches. In some embodiments the height of the back (2204) of the support pillow is 5, 5.5, 6, 6.5, 7, 7.25, 7.5, 7.75, 8, 8.25, 8.5, 8.75, 9, 9.25, 9.5, 9.75, 10, 10.5 or 11 inches. It is appreciated that each of the dimensions may be increased or decreased by 1%, 2%, 3%, 4%, 5%, 6%, 7%, 8%, 9%, 10%, 15%, 20%, 25%, 30%, 35%, 40%, 45% or 50%. In some embodiments the pillow has a contour at the top that is curved from back to front.

Figure 23:
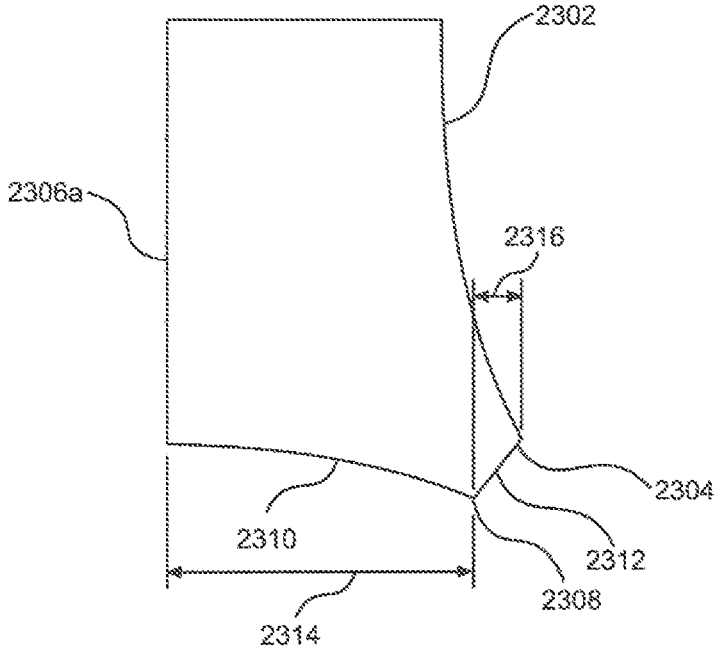
FIG. 23 depicts a lateral view of the support pillow.

FIG. 23 depicts a side view of the pillow (2306(*a*)). Some exemplary dimensions are set forth of the description to FIGS. 7 and 8. In addition, the width from the posterior of the pillow to the inferior most point of the pillow (2314) is 5.62 inches. The length from the inferior most point of the pillow and the anterior most point of the pillow (2316) is 0.78 inches. In some embodiments the width of the support pillow is greater at the bottom than at the top. That is, in some embodiments the width at the bottom is from 1 inch to 4 inches more than the width at the top of the pillow. In some embodiments the bottom is from 1.25 to 3 inches more than the width at the top of the pillow. In some embodiments the width at the bottom of the pillow is 0.5, 075, 1, 1.25, 1.5, 1.75, 2, 2.25, 2.5, 2.75 or 3 inches more than the width at the top of the pillow. In some embodiments the width of the support pillow at the top is from 3 to 10 inches, or from 4 to 8 inches or from 5 to 7.5 inches. In some embodiments the width is 3, 3.5, 4, 4.5, 5, 5.5, 6, 6.5, 7, 7.5 or 8 inches. In some embodiments the width at the bottom of the support pillow is from It is appreciated that each of the dimensions may be increased or decreased by 1%, 2%, 3%, 4%, 5%, 6%, 7%, 8%, 9%, 10%, 15%, 20%, 25%, 30%, 35%, 40%, 45% or 50%.

As can be seen in FIG. 23, in some embodiments the side of the support pillow comprises two curved regions. The first curved region (2302) is from the top, anterior edge of the sides, which curves from the top to bottom of the side or to a point that is at the maximal width of the bottom of the side (2304). In some embodiments the pillow comprises an edge (2312) that extends from the point having the widest width (2304) to a point in the posterior and inferior direction (2308). The second curved region (2310) extends from the inferior, posterior edge of the pillow to the point in the posterior and inferior direction (2308).

Figure 24:
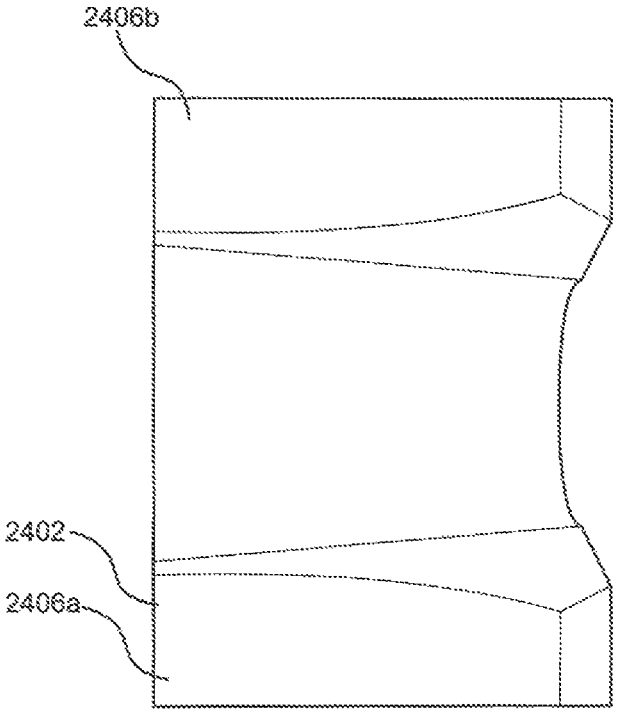
FIG. 24 depicts a front view of the support pillow.

FIG. 24 depicts a front view of the pillow (2402) as well as side rests ((2406(*a*) and 2406(*b*)) and provides exemplary dimensions in inches. As described previously, the posterior of the support pillow has a height but the overall height of the pillow may be longer. This is because in some embodiments the sides of the support pillow curve downward away from the back of the pillow, thereby increasing the overall height. In some embodiments the overall height of the pillow is 0.25 to 5 inches longer than the height of the back, or from 0.5 to 4 inches longer, or from 0.75 to 3 inches longer, or from 1 to 2 inches longer. In some embodiments the overall height of the support pillow is 0.5, 1, 1.5, 2, 2.5, 3, 3.5 or 4 inches longer than the back of the pillow. It is appreciated that each of the dimensions may be increased or decreased by 1%, 2%, 3%, 4%, 5%, 6%, 7%, 8%, 9%, 10%, 15%, 20%, 25%, 30%, 35%, 40%, 45% or 50%.

Figure 25:
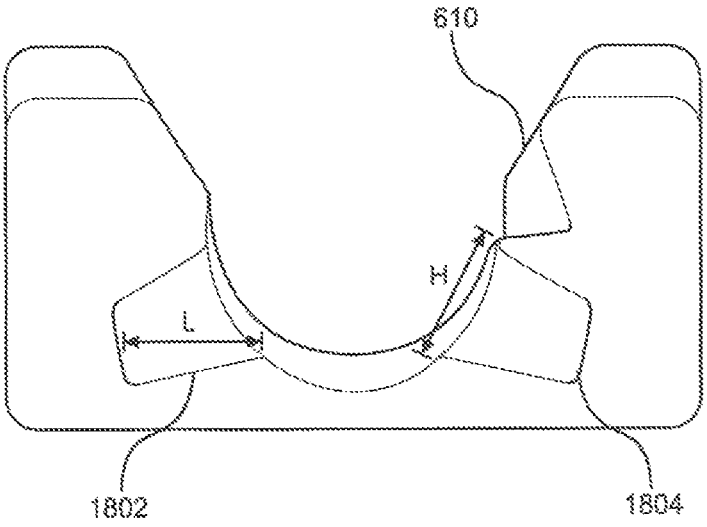
FIG. 25 depicts an inferior view of the support pillow.

FIG. 25 depicts an inferior view of the support pillow showing trapezius recesses (1802 and 1804) as well as a notch (610). Exemplary dimensions of each of the features of the travel pillow are provided. While the notch (610) may take a variety of shapes, such as a square, rectangle, scalene, triangle, or circle, a scalene shape is exemplified in FIG. 25. Turning to the trapezius recesses, each of the trapezius recesses is configured to receive the trapezius muscle of the user. The trapezius recesses have a length (L), height (H) and depth (D). In some embodiments the length of each of the trapezius recesses is from 1 to 4, or 1.5 to 3 or from 2 to 2.5 inches. In some embodiments the length of the shoulder recess is 1, 1.5, 2, 2.5, 3, 3.5, 4, 4.5 or 5 inches. In some embodiments the top of the shoulder recess is shorter than the bottom of the shoulder recess due to the curvature of the head rest. The height of the trapezius recesses is from 0.5 to 4, or 1.0 to 3 or from 2 to 2.5 inches. In some embodiments the length of the shoulder recess is 0.5, 1, 1.5, 2, 2.5, 3, 3.5, 4, 4.5 or 5 inches. It is appreciated that each of the dimensions may be increased or decreased by 1%, 2%, 3%, 4%, 5%, 6%, 7%, 8%, 9%, 10%, 15%, 20%, 25%, 30%, 35%, 40%, 45% or 50%.

Figure 26:
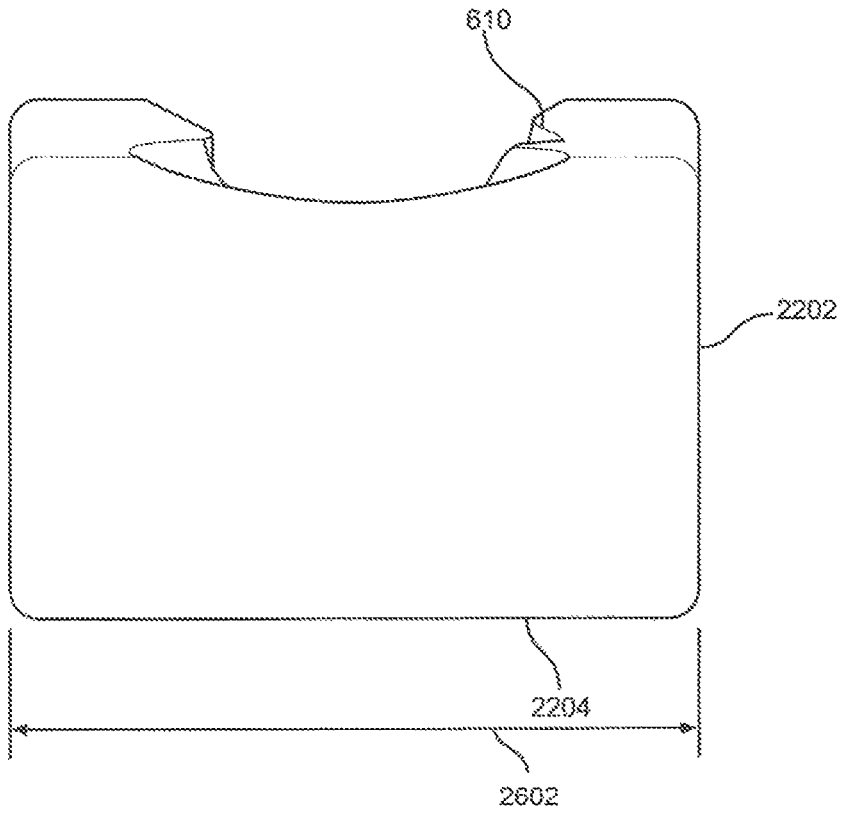
FIG. 26 depicts a rear, inverted (upside down) view of the support pillow.

FIG. 26 depicts a perspective posterior view of the support pillow while upside down, highlighting the notch (610) as well as side (2202) and posterior (2204) of the pillow. Exemplary length (2602) of the pillow is 11.55 inches. It is appreciated that each of the dimensions may be increased or decreased by 1%, 2%, 3%, 4%, 5%, 6%, 7%, 8%, 9%, 10%, 15%, 20%, 25%, 30%, 35%, 40%, 45% or 50%.

Figure 27:
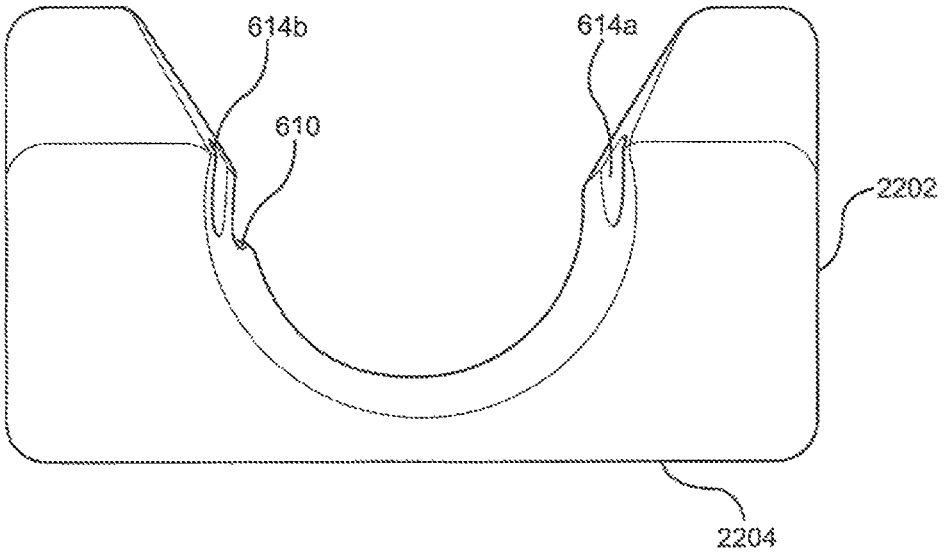
FIG. 27 depicts a top view of the support pillow.

FIG. 27 depicts a superior view of the support pillow showing ear cavities (614(*a*) and 614(*b*)) as well as notch (610), side (2202) and posterior (2204).

Figure 28A:
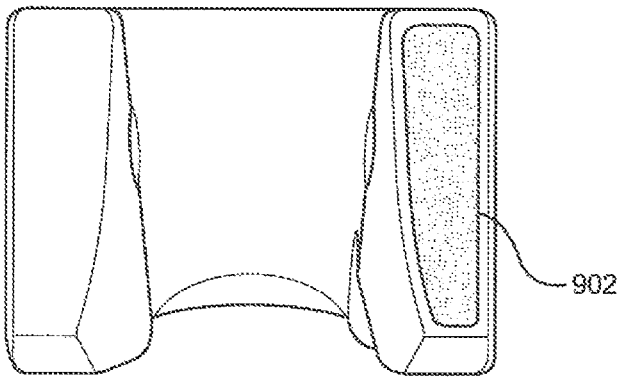
FIG. 28(A) depicts a front view of the support pillow.

FIG. 28(A) shows an anterior view of the support pillow showing the front support (902). In some embodiments the front panel (902) is from 4 to 10 inches in height, depending on the height of the side of the pillow. In some embodiments the panel is from 6 to 8 inches in height. In some embodiments the width of the panel may not be uniform so as to accommodate the width of the underlying pillow section but in some embodiments it is from 0.5 to 3 inches wide, or from 1 to 2 inches wide. It is appreciated that each of the dimensions may be increased or decreased by 1%, 2%, 3%, 4%, 5%, 6%, 7%, 8%, 9%, 10%, 15%, 20%, 25%, 30%, 35%, 40%, 45% or 50%. It is appreciated that the front support may occupy at least 70%, 75%, 80%, 85%, 90%, 91%, 92%, 93%, 94%, 95%, 96%, 97%, 98%, or 100% of the anterior edge of the pillow.

Figure 28B:
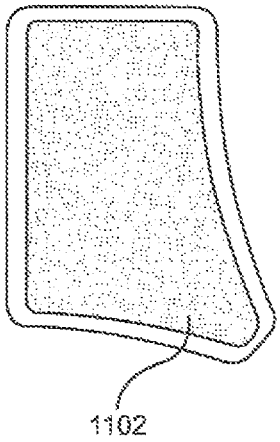
FIG. 28(B) depicts a lateral view of the support pillow.

FIG. 28(B) shows an lateral view of the support pillow showing the rigid support (1102). In some embodiments the lateral panel (1102) is from 5 to 10 inches in height, depending on the height of the side of the pillow. In some embodiments the panel is from 6 to 8 inches in height. In some embodiments the height of the panel may not be uniform so as to accommodate the height of the underlying pillow section. In some embodiments the width of the lateral panel is from 3 to 7 inches, or from 3.5 to 6 inches or from 4 to 5.5 inches. In some embodiments the width of the panel may not be uniform so as to accommodate the width of the underlying pillow section. It is appreciated that each of the dimensions may be increased or decreased by 1%, 2%, 3%, 4%, 5%, 6%, 7%, 8%, 9%, 10%, 15%, 20%, 25%, 30%, 35%, 40%, 45% or 50%. It is appreciated that the lateral support may occupy at least 70%, 75%, 80%, 85%, 90%, 91%, 92%, 93%, 94%, 95%, 96%, 97%, 98%, or 100% of the lateral side of the pillow.

Figure 28C:
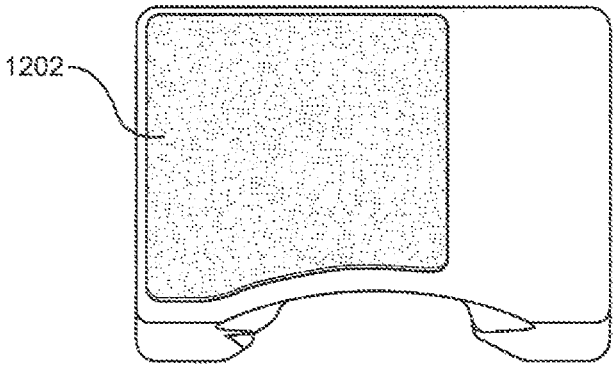
FIG. 28(C) depicts a rearview of the support pillow.

FIG. 28(C) shows a posterior view of the support pillow, noting exemplary dimensions of the posterior support (1202). Exemplary dimensions of each of the features of the travel pillow are provided. In some embodiments the posterior panel (1102) is from 3.5 to 10 inches in height, depending on the height of the back of the pillow. In some embodiments the panel is from 5.75 to 8 inches in height. In some embodiments the height of the panel may not be uniform so as to accommodate the height of the underlying pillow section. In some embodiments the width of the lateral panel is from 3 to 10 inches, or from 4 to 8 inches or from 5 to 7 inches. In some embodiments the width of the panel may not be uniform so as to accommodate the width of the underlying pillow section. It is appreciated that each of the dimensions may be increased or decreased by 1%, 2%, 3%, 4%, 5%, 6%, 7%, 8%, 9%, 10%, 15%, 20%, 25%, 30%, 35%, 40%, 45% or 50%. It is appreciated that the front support may occupy at least 50%, 55%, 60%, 65%, 70%, 75%, 80%, 85%, 90%, 91%, 92%, 93%, 94%, 95%, 96%, 97%, 98%, or 100% of the posterior edge of the pillow.

Figure 29:
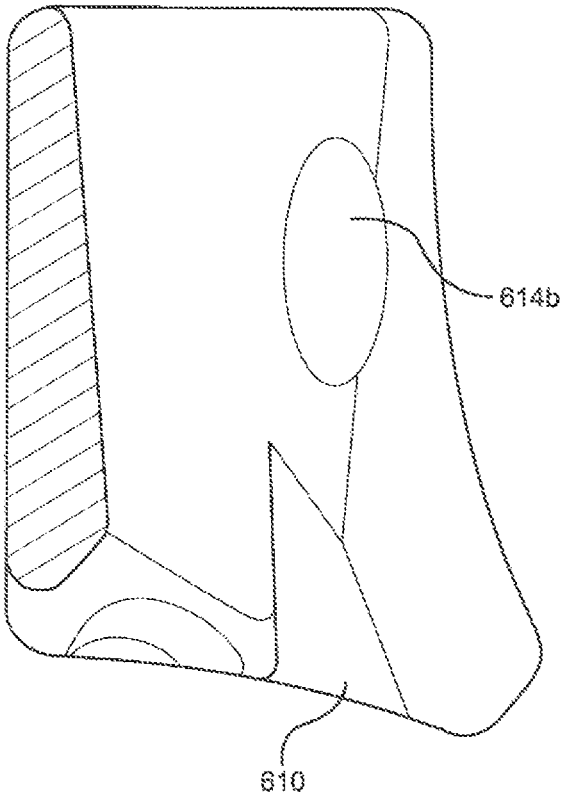
FIG. 29 depicts a view of the interior of a side of the support pillow.

FIG. 29 depicts an interior view of the lateral sides showing notch (610) and ear cavity (614(*b*)).

Figure 30:
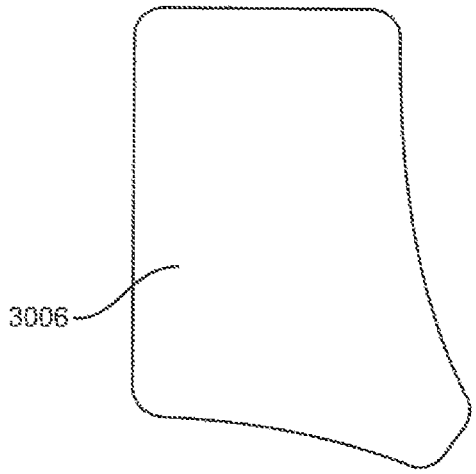
FIG. 30 depicts a view of the exterior of a side of the support pillow.

FIG. 30 depicts an exterior lateral view of side (3006). Exemplary dimensions of each of the features of the travel pillow are provided in the description of FIG. 7 and FIG. 8. It is appreciated that each of the dimensions may be increased or decreased by 1%, 2%, 3%, 4%, 5%, 6%, 7%, 8%, 9%, 10%, 15%, 20%, 25%, 30%, 35%, 40%, 45% or 50%. In some embodiments the radius of curvature of the inferior edge of the side rest is from around 30 to 50 cm, from around 32 to 47 cm, from around 35 to 45 cm, from around 38 to 42, cm, from 39 to 40 cm. In some embodiments the radius of curvature of the inferior edge of the side rest is around 30 cm, 31 cm, 32 cm, 33 cm, 34 cm, 35 cm, 36 cm, 37 cm, 38 cm, 39 cm, 40 cm, 41 cm, 42 cm, 43 cm, 44 cm, 45 cm, 46 cm, 47 cm, 48 cm, 49 cm or 50 cm. In some embodiments the radius of curvature of the anterior edge of the side rest is from around 30 to 50 cm, from around 32 to 47 cm, from around 35 to 45 cm, from around 38 to 42, cm, from 39 to 41 cm. In some embodiments the radius of curvature of the anterior edge of the side rest is around 30 cm, 31 cm, 32 cm, 33 cm, 34 cm, 35 cm, 36 cm, 37 cm, 38 cm, 39 cm, 40 cm, 41 cm, 42 cm, 43 cm, 44 cm, 45 cm, 46 cm, 47 cm, 48 cm, 49 cm or 50 cm.

Figure 31:
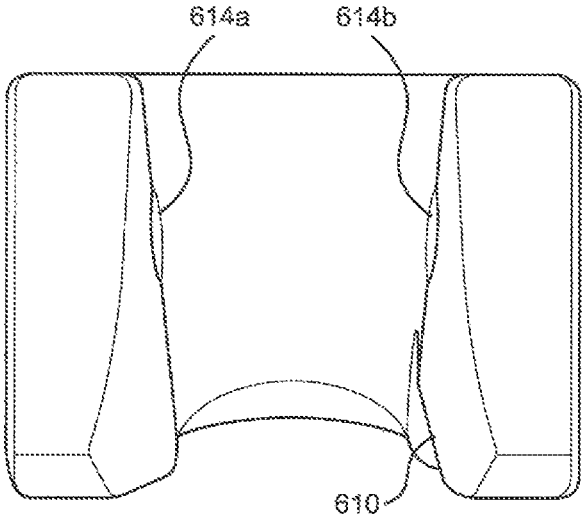
FIG. 31 depicts a front view of the support pillow.

FIG. 31 depicts a front view of pillow showing ear cavities ((614(*a*) and 614(*b*)) as well as notch (610). Exemplary dimensions of each of the features of the travel pillow are provided in the description of FIG. 7 and FIG. 8. It is appreciated that each of the dimensions may be increased or decreased by 1%, 2%, 3%, 4%, 5%, 6%, 7%, 8%, 9%, 10%, 15%, 20%, 25%, 30%, 35%, 40%, 45% or 50%.

Figure 32A:
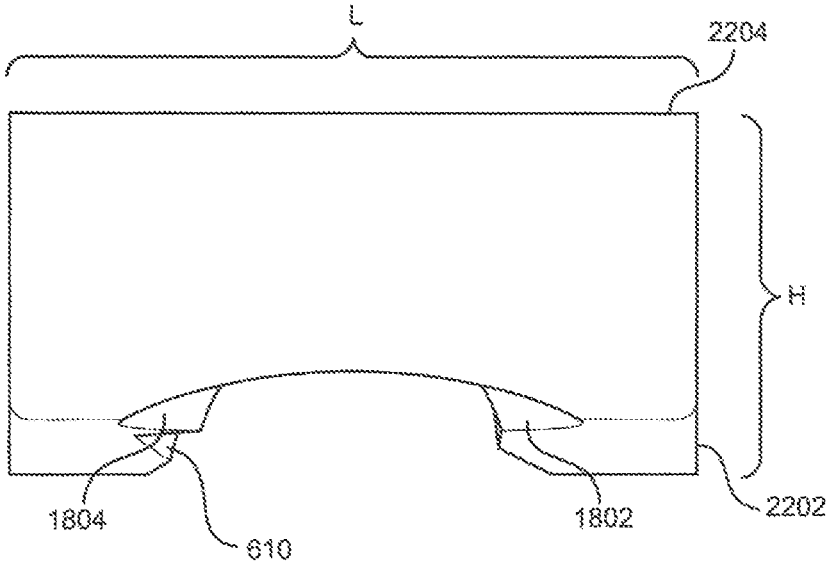
FIG. 32(A) depicts a rear view of a shorter support pillow.
Figure 32B:
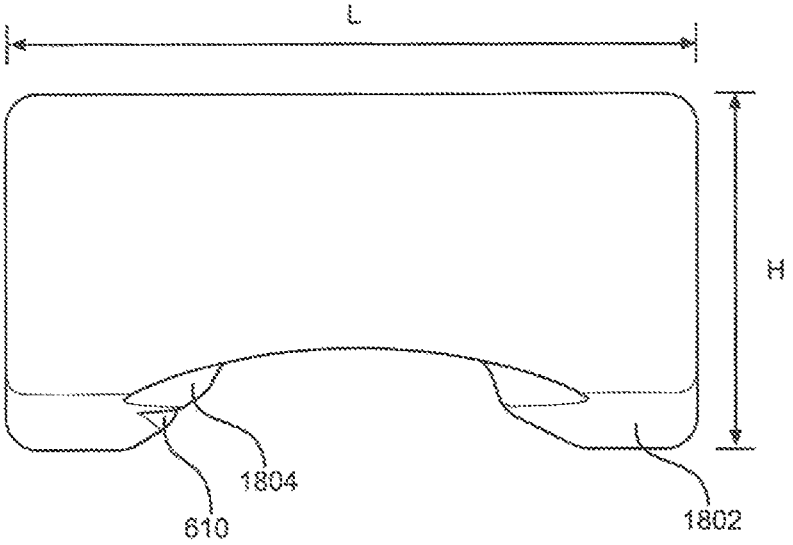
FIG. 32(B) depicts a shorter support pillow with rounded edges.

Turning to FIG. 32(A), a posterior, perspective depiction of a shorter support pillow is provided. In this embodiment the measurements of the pillow may be similar to that described herein except the overall height of the pillow is shorter. In this embodiment, because the pillow comprises sides the curve downward toward the chest of the user, the overall height is around 5 inches to 7 inches. In some embodiments the overall height is around 5.5 inches to 6.5 inches. In some embodiments the overall height is around 5, 5.5, 6, 6.5 or 7 inches. In this embodiment the height of the back of the support pillow is around 4 inches to 6 inches. In some embodiments the height of the back of the pillow is around 4, 4.5, 5, 5.5 or 6 inches. FIG. 32(B) provides an alternative presentation of the view of FIG. 32(A) except the edges of the pillow are rounded to provide additional comfort and safety to the user.

Figure 33A:
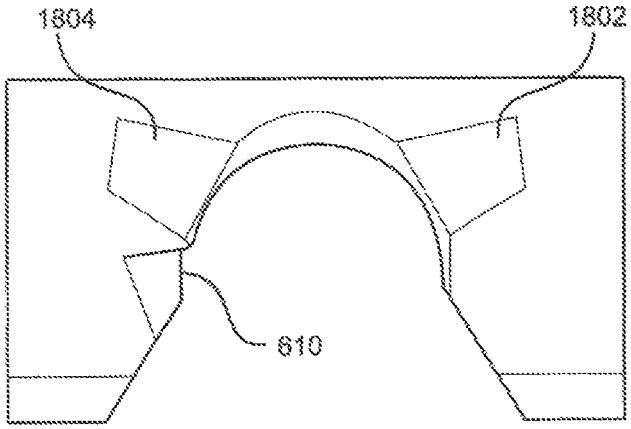
FIG. 33(A) depicts an inferior view of a shorter support pillow.
Figure 33B:
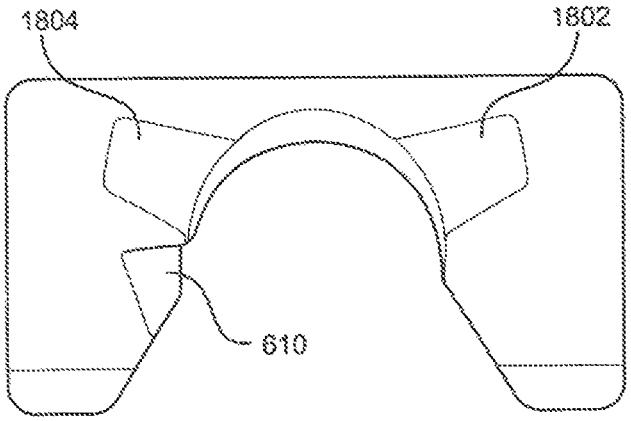
FIG. 33(B) depicts a shorter support pillow with rounded edges.

FIG. 33(A) depicts an inferior view of the support pillow. As outlined in FIG. 32, in some embodiments the support pillow is shorter. That is, the height is shorter, although other measurements are similar to that described herein. FIG. 33(A) depicts trapezius recesses (1802 and 1804) as well as notch (610). Exemplary dimensions of each of the features of the travel pillow are provided. While notch (610) may take a variety of shapes, such as a square, rectangle, scalene, triangle, or circle, a scalene shape is exemplified in FIG. 33(A). Turning to the trapezius recesses, each of the trapezius recesses is configured to receive the trapezius muscle of the user. The trapezius recesses have a length (l), height (h) and depth (d). In some embodiments the length of each of the trapezius recesses is from 1 to 4, or 1.5 to 3 or from 2 to 2.5 inches. In some embodiments the length of the shoulder recess is 1, 1.5, 2, 2.5, 3, 3.5, 4, 4.5 or 5 inches. In some embodiments the top of the shoulder recess is shorter than the bottom of the shoulder recess due to the curvature of the head rest. The height of the trapezius recesses is from 0.5 to 4, or 1.0 to 3 or from 2 to 2.5 inches. In some embodiments the length of the shoulder recess is 0.5, 1, 1.5, 2, 2.5, 3, 3.5, 4, 4.5 or 5 inches. It is appreciated that each of the dimensions may be increased or decreased by 1%, 2%, 3%, 4%, 5%, 6%, 7%, 8%, 9%, 10%, 15%, 20%, 25%, 30%, 35%, 40%, 45% or 50%. FIG. 33(B) provides an alternative presentation of the view of FIG. 33(A) except the edges of the pillow are rounded to provide additional comfort and safety to the user.

FIG. 34 (A) depicts a side view of a shorter pillow (2306(A)) and provides exemplary dimensions in inches. As outlined in FIG. 32, in some embodiments the support pillow is shorter. That is, the height is shorter, although other measurements are similar to that described herein. In some embodiments the width of the support pillow is greater at the bottom than at the top. That is, in some embodiments the width at the bottom is from 1 inch to 4 inches more than the width at the top of the pillow. In some embodiments the width at the bottom is from 1.25 to 3 inches more than the width at the top of the pillow. In some embodiments the width at the bottom of the pillow is 0.5, 075, 1, 1.25, 1.5, 1.75, 2, 2.25, 2.5, 2.75 or 3 inches more than the width at the top of the pillow. In some embodiments the width of the support pillow at the top is from 3 to 10 inches, or from 4 to 8 inches or from 5 to 7.5 inches. In some embodiments the width is 3, 3.5, 4, 4.5, 5, 5.5, 6, 6.5, 7, 7.5 or 8 inches. It is appreciated that each of the dimensions may be increased or decreased by 1%, 2%, 3%, 4%, 5%, 6%, 7%, 8%, 9%, 10%, 15%, 20%, 25%, 30%, 35%, 40%, 45% or 50%.

Figure 34A:
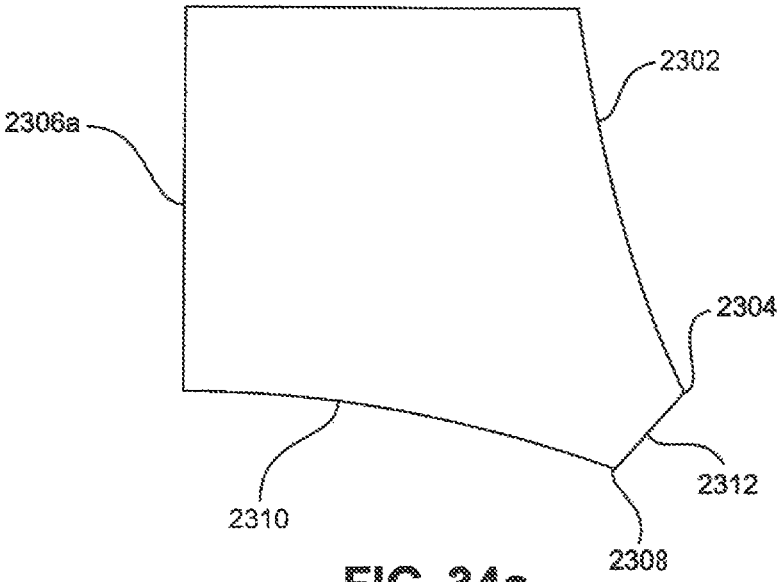
FIG. 34(A) depicts a side view of a shorter support pillow.
Figure 34B:
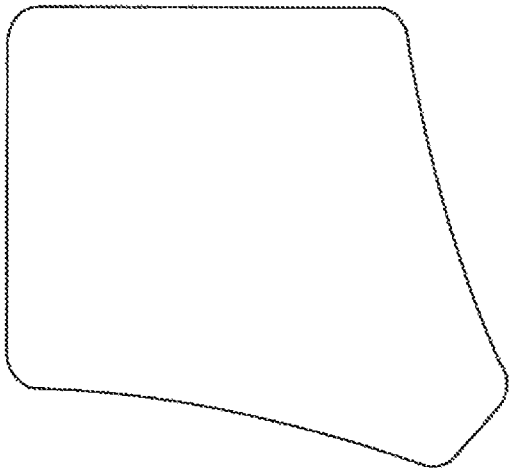
FIG. 34(B) depicts a shorter support pillow with rounded edges.

As can be seen in FIG. 34, in some embodiments the side of the support pillow comprises two curved regions. The first curved region (2302) is from the top, anterior edge of the sides, which curves from the top to bottom of the side or to a point that is at the maximal width of the bottom of the side (2304). In some embodiments the pillow comprises an edge (2312) that extends from the point having the widest width (2304) to a point in the posterior and inferior direction (2308). The second curved region (2310) extends from the inferior, posterior edge of the pillow to the point in the posterior and inferior direction (2308). In this embodiment, because the pillow comprises sides the curve downward toward the chest of the user, the overall height is around 5 inches to 7 inches. In some embodiments the overall height is around 5.5 inches to 6.5 inches. In some embodiments the overall height is around 5, 5.5, 6, 6.5 or 7 inches. In this embodiment the height of the back of the support pillow is around 4 inches to 6 inches. In some embodiments the height of the back of the pillow is around 4, 4.5, 5, 5.5 or 6 inches. FIG. 34(B) provides an alternative presentation of the view of FIG. 34(A) except the edges of the pillow are rounded to provide additional comfort and safety to the user.

Figure 35A:
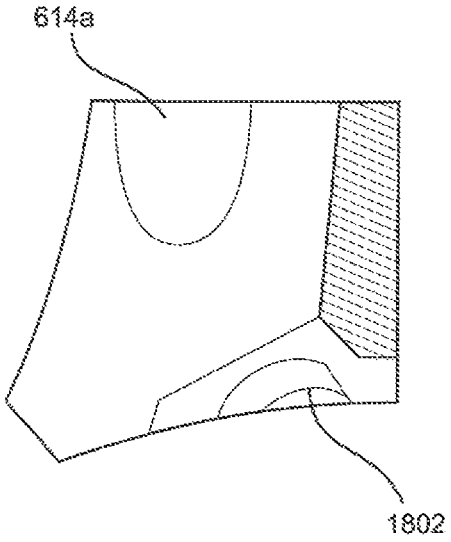
FIG. 35(A) depicts a side, interior view of a shorter support pillow.
Figure 35B:
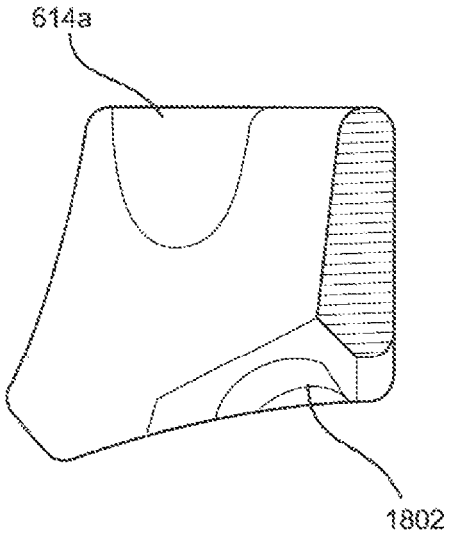
FIG. 35(B) depicts a shorter support pillow with rounded edges.

FIG. 35(A) and FIG. 35(B) depict an interior view of the lateral sides showing ear cavity or recess (614(B)) and trapezius recess (1802). Again, because the pillow comprises sides the curve downward toward the chest of the user, the overall height is around 5 inches to 7 inches. In some embodiments the overall height is around 5.5 inches to 6.5 inches. In some embodiments the overall height is around 5, 5.5, 6, 6.5 or 7 inches. In this embodiment the height of the back of the support pillow is around 4 inches to 6 inches. In some embodiments the height of the back of the pillow is around 4, 4.5, 5, 5.5 or 6 inches. It is appreciated that each of the dimensions may be increased or decreased by 1%, 2%, 3%, 4%, 5%, 6%, 7%, 8%, 9%, 10%, 15%, 20%, 25%, 30%, 35%, 40%, 45% or 50%. Notably in the pillow configuration depicted in FIG. 35 (A), the ear recesses are at the superior edge of the pillow. The height of the ear recess is around 2 inches, 2.25, inches, 2.38 inches, 2.5 inches 2.75 inches or 3 inches. FIG. 35(B) provides an alternative presentation of the view of FIG. 35(A) except the edges of the pillow are rounded to provide additional comfort and safety to the user.

Figure 36A:
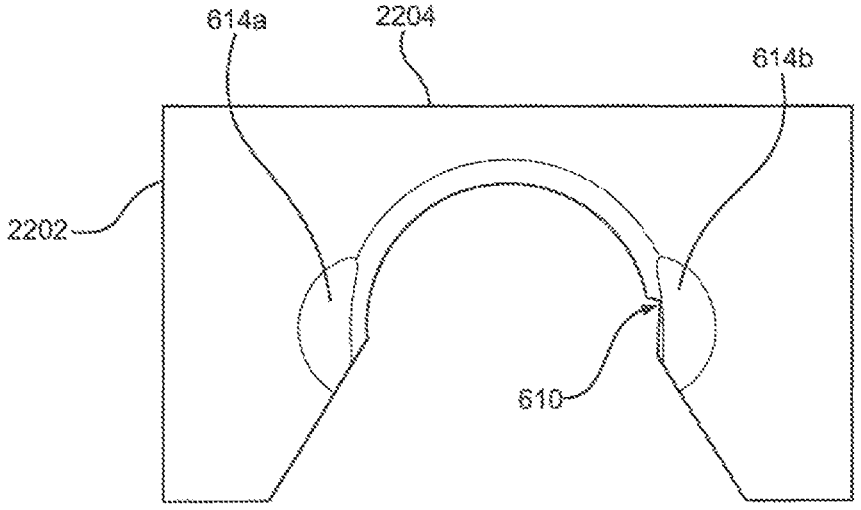
FIG. 36(A) depicts a top view of a shorter support pillow.
Figure 36B:
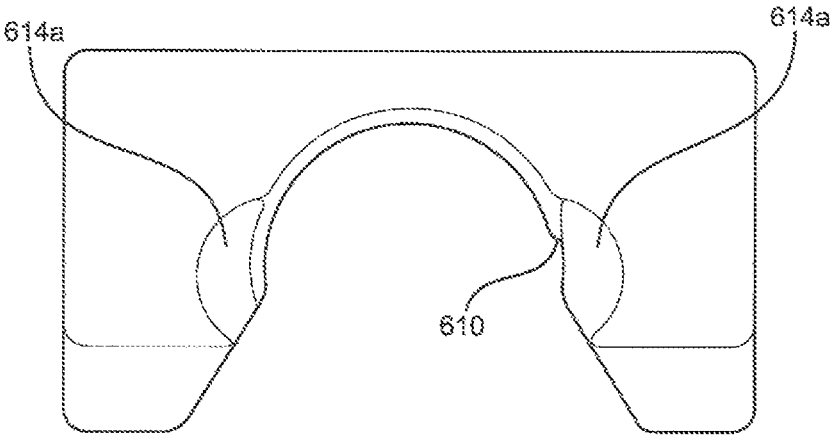
FIG. 36(B) depicts a shorter support pillow with rounded edges.

FIG. 36 depicts a superior view of the support pillow showing ear cavities or recesses (614(*a*) and 614(*b*)) as well as notch (610), side (2202) and posterior (2204). Exemplary dimensions of each of the features of the travel pillow have been provided previously. It is appreciated that each of the dimensions may be increased or decreased by 1%, 2%, 3%, 4%, 5%, 6%, 7%, 8%, 9%, 10%, 15%, 20%, 25%, 30%, 35%, 40%, 45% or 50%. FIG. 36(B) provides an alternative presentation of the view of FIG. 36(A) except the edges of the pillow are rounded to provide additional comfort and safety to the user.

Figure 39:
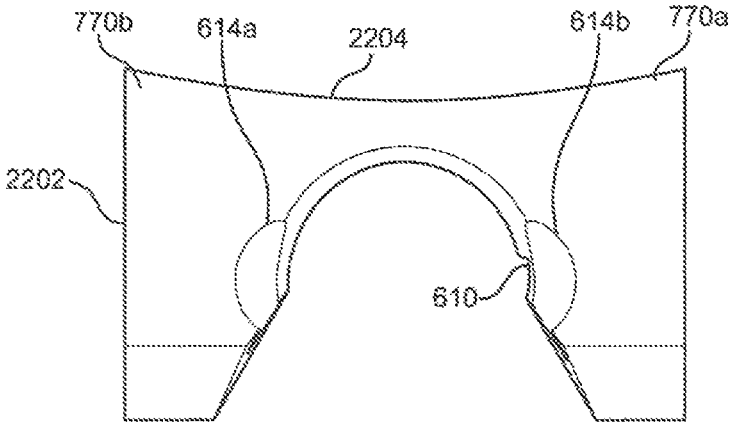
FIG. 39 depicts a top view of the pillow with an extension behind each side rest that is triangular in shape as viewed from above or below and extends from ½ inch to 1 inch posteriorly at its thickest portion.

In some embodiments of the pillow including those of both the "tall" and "short" variations in pillow height as described above, the pillow comprises an extension behind each side rest that is triangular in shape (770*a* and 770*b*) as viewed from above or below and extends from ½ inch to 1 inch posteriorly at its thickest portion. See FIG. 39. The purpose of the extensions is to angle the anterior portion of the side rests inward to better fit the head and neck of the user when the user's head presses the head rest portion of the pillow against the seat back, bed, or other surface. The triangular shape of these extensions ensures maximal surface area contact of the pillow with the surface against which it is pressed, thereby increasing friction and hence stability. The width of the triangular extensions may comprise between ten percent and fifty percent, preferably thirty percent, of the width of the pillow; and its height may comprise between ten percent and one hundred percent, preferably one hundred percent, of the height of the pillow. In some embodiments the triangular extension is curved to match the "bevel" curvature of the pillow's edges as elsewhere described and illustrated, and in some embodiments it is rectangular as viewed from above or below rather than triangular. In these embodiments the rigid support on the back of the pillow may be bent, curved, or otherwise contoured to match the extension rather than being flat.

Figure 40:
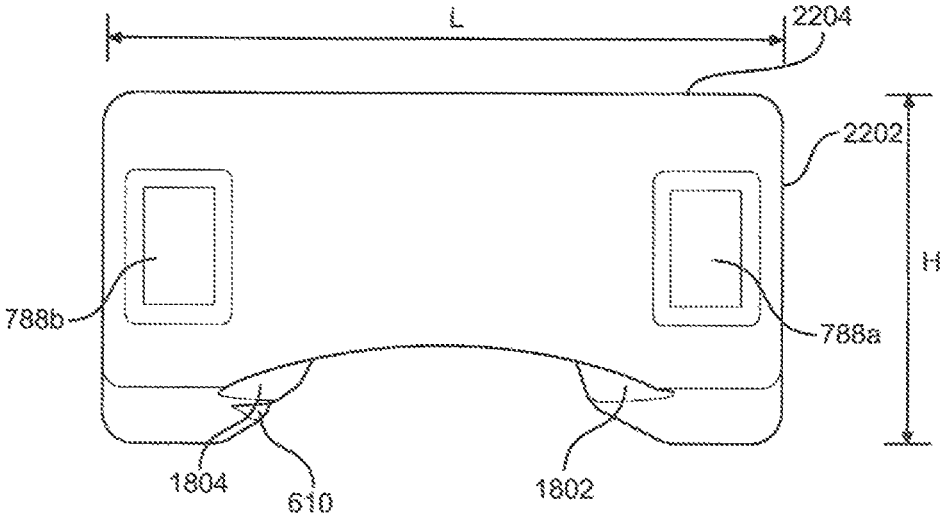
FIG. 40 depicts a pillow with button-like extensions serving the purpose of helping to angle the anterior portion of the side rests inward to better fit the head and neck of the user when the user's head presses the head rest portion of the pillow against the seat back, bed, or other surface.

In some embodiments the pillow has between and one and five simple circular, square, or rectangular extensions (788*a* and 788*b*) measuring between one inch and five inches, preferable two inches, in width (and if rectangular, between one inch and five inches in height), preferably lying within each lateral one-tenth to one-third, preferable one-fourth, of the back of the pillow. See FIG. 40. These button-like extensions serve the purpose of helping to angle the anterior portion of the side rests inward to better fit the head and neck of the user when the user's head presses the head rest portion of the pillow against the seat back, bed, or other surface. In these embodiments the rigid support on the back of the pillow may be bent, curved, or otherwise contoured to match the extension rather than being flat.

In some embodiments the pillow further comprises an attachment to secure the front compressed panels. See FIG. 13(C) (1302) The attachment may be buckles, ties, button, Velcro® hook and loop assembly, and/or hooks, and the like. In some embodiments the collapsed pillow comprises a compression system to facilitate compression of the collapsed pillow. This compression system may be comprised of straps, buckles, ties, Velcro® hook and loop assembly, ratchet system, and the like. See (1304(*a*) and 1304(*b*)).

In some embodiments a box or "exoskeleton" is used to provide packaging for product and/or to facilitate locking in a compressed position. This may be made from flexible or firm plastic, metal, wood or any material that provides protection for the pillow. In some embodiments this piece will also be made from Polylactic Acid. All plastic parts may be made using standard injection molding.

In some embodiments the pillow is further configured to carry or have integrated a variety of elements. In one embodiment the pillow comprises a vertically-oriented slit to accommodate the wire of third party wired ear bud speakers or BLUETOOTH® wireless speakers. In some embodiments the slit may also function as a receptive recess for the contralateral arm of the pillow to insert into when folded for portability.

In one embodiment the pillow is configured to have speakers integrated into the foam positioned at or near the ear holes. In this embodiment the pillow may have wiring to connect the speakers and may also have wiring to allow for audio input. In some embodiments the speakers have BLUETOOTH® wireless technology for wireless connectivity to audio inputs. In some embodiments, the pillow also comprises a battery, a charger, and/or electrical plugs as necessary.

In some embodiments the support pillow is configured with recharging batteries for portable electronics, such as mobile phones, tablets, computers and the like, and/or pockets for insertion of recharging batteries. In addition, the support pillow may be configured with a variety of plugs, such as, but not limited to USB and/or USB-c ports, micro-USB ports and the like. In some of these embodiments the recharging mechanism is wireless, with or without magnetic attachment capability.

In some embodiments the support pillow may be configured to have electrical heater and/or massagers for added comfort for the user. In one embodiment the pillow has an integrated vibrating or other head and/or neck massage and/or heating and/or cooling mechanism. In addition, In some embodiments the pillow may further be configured to have integrated storage compartment or compartments for holding items such as but not limited to sunglasses, cell phones, pens and the like.

Figure 37A:
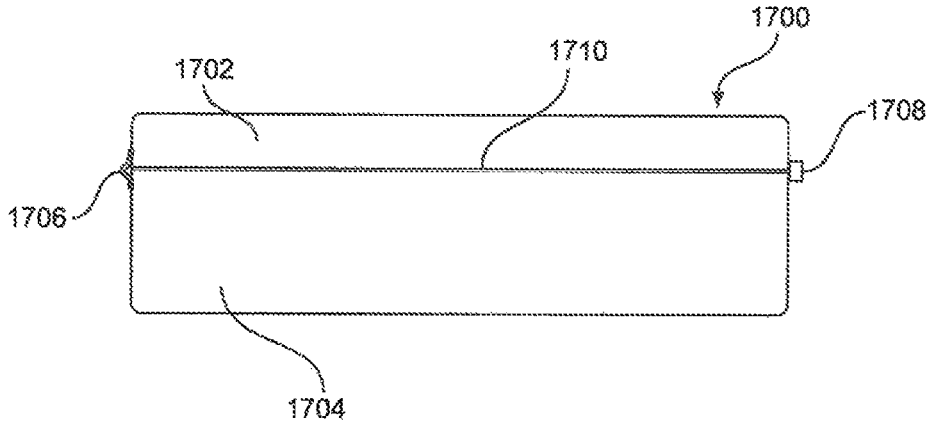
FIG. 37 depicts the multi-compartment carrier described herein.
Figure 37B:
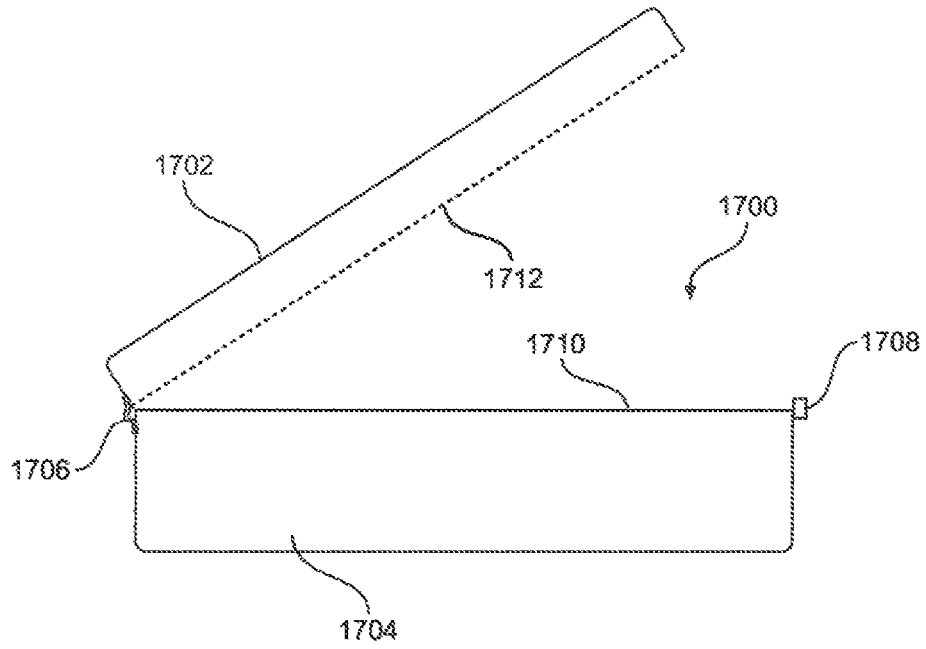
Figure 37C:
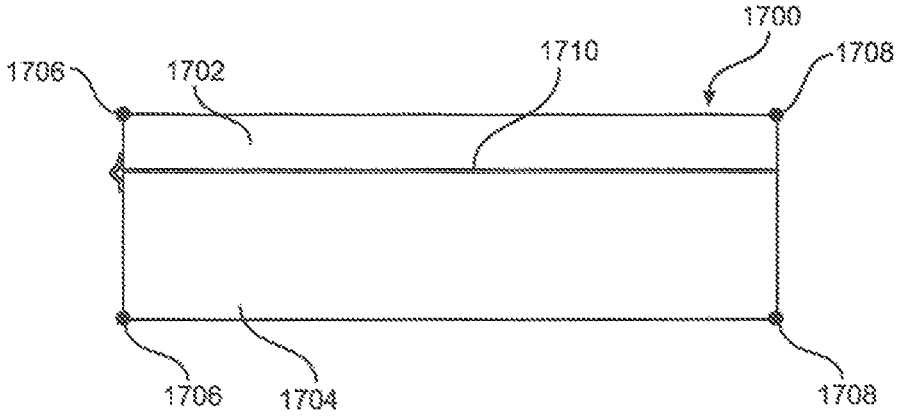
Figure 37D:
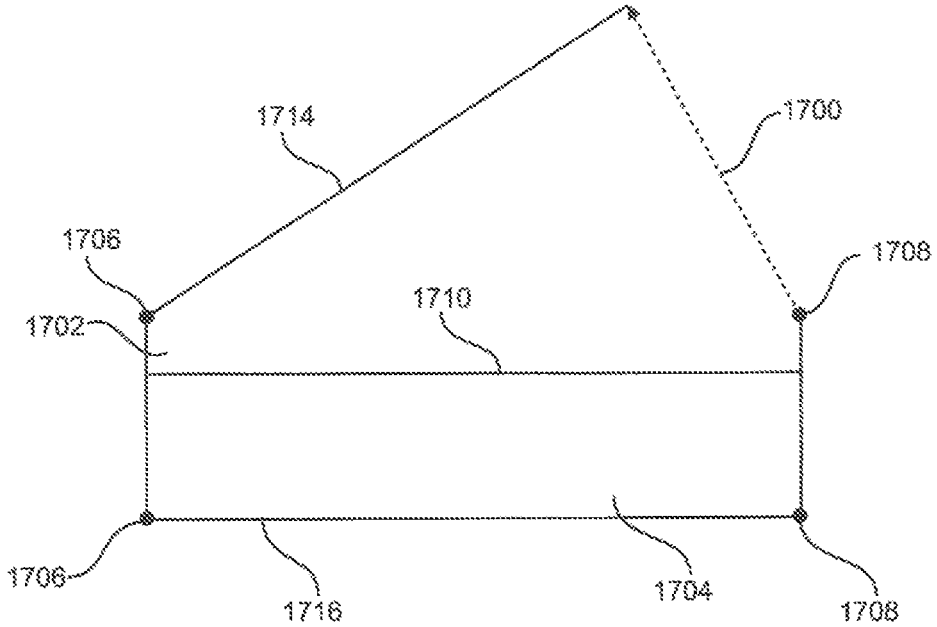

In one embodiment the pillow finds use as a component of a multi-component carrier (1700). FIG. 37 is a side view of the multi-component carrier. In this embodiment the carrier comprises two compartments (1702, 1704) that share a central barrier or wall (1710). The multi-component carrier has one compartment configured to store the pillow (1704) as described herein, and an adjacent compartment for storage of additional items (1702). A hinge system (1706) allows for opening one side at a time. A closure mechanism (1708) allows for opening of one side at a time or both sides simultaneously. In some embodiments this also features a lock. In some embodiments each chamber is the same size. In other embodiments the chambers are asymmetric. One side is configured to hold the pillow described herein and more particularly is configured to hold the compressed pillow described herein. The other compartment may include a foam lined interior to protect the contents of this chamber. When one hinge (1706) is used as shown in FIG. 37(A) and FIG. 37(B), the compartment for additional items (1702) may also include an internal base (1712) to hold contents in place when the chamber is open. Conveniently, when one compartment is face down, the upper case may be opened. Then, to open the other compartment the carrier is flipped over. When a two hinge system is used as shown in FIG. 37(C) and FIG. 37(D), only the lids (1714, 1716) of each chamber open leaving the walls of the compartment attached to or integrated with the base (1710). This serves to ensure that the contents of the compartment are not spilled when the lid is opened. Contents may include, but are not limited to, cell phones, pens, keys, wallets, business cards, money, glasses, sunglasses, and other small personal items. In another embodiment, temporary storage of such items on a more limited basis may be placed or inserted into small external pocket(s) on the outer sides of the pillow itself with such pockets in one embodiment being sealable by zipper, Velcro® hook and loop assembly, or like present art or in another embodiment being unsealed but low profile to hold items for temporary storage.

Figure 41:
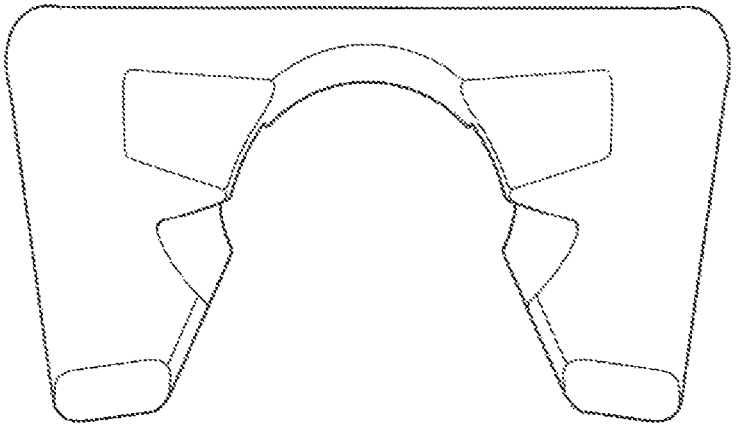
FIG. 41 depicts a pillow with side headrests angled inward to provide additional support in a way that keeps the head facing directly forward while minimizing tilting to the sides.

In some embodiments the pillow's side headrests are angled inward to angles ranging from five degrees to thirty degrees; in some embodiments 5 to twenty degrees, 10 to twenty degrees; in some embodiments 12 to 17 degrees. In some embodiments the headrests are angled in ward to angles of 10, 11, 12, 13, 14, 15, 16, 17, 18, 19 or 20 degrees. In some of these embodiments the posterior firm panel occupies the sixty to seventy percent of the posterior surface towards the side head rest with no side panel, which allows the contralateral side rest to hinge laterally to accommodate the head and neck of the use as it is put into place, after which it returns to its inwardly-angled position. See FIG. 41. The purpose of the inward angle is to provide more secure support of the head and neck, duplicating the effect of the posterior wedge extensions described elsewhere without the need for active pressure applied to the back of the pillow by the seat back or other surface on which it is rested in order to achieve this effect. It is appreciated that in these embodiments, due to compression by the inward-angling of the side rest, the dimensions of the head support are reduced, with the average radius of the head support being around 6 cm at its top portion, and tapering to around 4.75 cm at its bottom portion.

Figure 42:
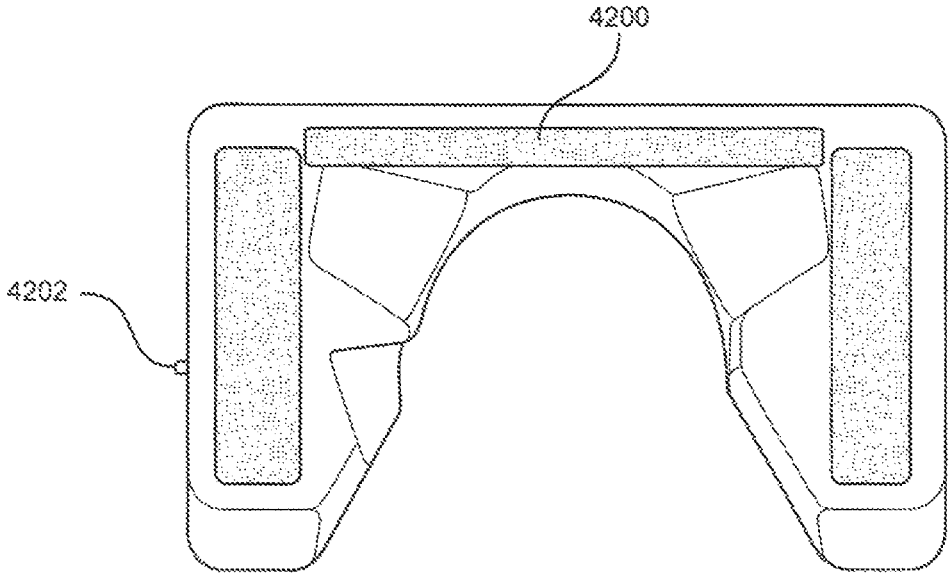
FIG. 42 depicts a pillow containing air bladders and an external nozzle for inflation and deflation of these air bladders.

In some embodiments the pillow contains air bladders (4200) and an external nozzle (4202) for inflation and deflation of these air bladders. See FIG. 42. This nozzle may have a one-way valve which may be released manually in some of these embodiments. The nozzle may be configured in any location on the pillow so long as it does not interfere with the function and/or comfort of the pillow. In some of these embodiments the air bladders occupy only the side headrest portion of the pillow with a connection between them via the back of the head rest so that they may be inflated simultaneously; in others there is also an air bladder occupying the posterior head rest also. The proportion the pillow which these air bladders occupy may range from ten percent to one hundred percent (the latter of which will be a pillow that is entirely inflatable, with a thin layer of foam or other soft coating); preferably thirty percent. The purpose of the air bladders is twofold: one, to provide firmness when they are inflated fully, which may vary when they are not fully inflated; which firmness is balanced by the foam on the outside of the air bladders, whose density and shape specifications are specified elsewhere (minus the internal portion reserved in the present embodiments for the air bladders); and two, to provide for portability when fully deflated. In some of these embodiments the firm panels' placement and folding configuration are those specified elsewhere, and in some embodiments the panel on the posterior surface occupies its central portion, ranging from thirty percent to one hundred percent, preferably seventy percent. In these configurations the side arms both fold towards the center of the pillow when deflated, symmetrically; they overlap as necessary when the pillow is folded into this flat configuration. In some of these embodiments, the side panels are placed on both sides with percentage of coverage ranging as described elsewhere for the panels as placed on only one side. In some of these embodiments the front panels are absent, and in some they are placed on the front surface of each side rest, symmetrically. In some embodiments of the inflatable pillow there are no firm panels on any surface. In some of these embodiments without firm panels there are rubber, polyurethane, or other tacky surfaces on the posterior aspect of the pillow, occupying between 30 and 100 percent, preferably 95 percent, whose purpose is to create adherence through friction between the posterior surface of the pillow and the seat back or other flat surface against which it rests, as otherwise described in reference to the firm panels. The air bladders may be present in all of the embodiments described elsewhere including that above with angled side head rests.

Alternative embodiments are envisioned wherein the pillow has dimensions to accommodate the head, neck, and shoulders of children between toddler and teen ages. These embodiments would encompass the range of other versions mentioned above and below with the exception that all of its measurements are smaller but in exact or approximate proportion to those of the above and below mentioned embodiments. The size ratio of these alternative embodiments to the elsewhere described embodiments would be 50, 55, 60, 65, 70, 75, 80, 85, 90, and 95 percent, preferably between 70 and 85 percent.

In the shorter of these embodiments, the overall height is around 3 inches to 6 inches. In some embodiments the overall height is around 3 inches to 5.5 inches. In some embodiments the overall height is around 3 3.5, 4, 4.5, 5, 5.5, or 6 inches. In this embodiment the height of the back of the support pillow is around 3 inches to 5 inches. In some embodiments the height of the back of the pillow is around 4, 4.5, 5, 5.5 or 6 inches. The size ratio of these alternative embodiments to the elsewhere described embodiments may be 50, 55, 60, 65, 70, 75, 80, 85, 90, and 95 percent, preferably between 70 and 85 percent.

In the taller of these embodiments, the pillow has a height ranging from around 7 inches to around 10 inches.

In these smaller embodiments the head recess may vary in proportion to the overall dimensions to reflect the difference in head-to-neck-to shoulder ratios of toddlers and children relative to those of adults. The radius (exact if circular, average if elliptical) at the top of the top portion may lie between 4 and 7 cm, and between 2 cm and 3 cm, preferably between 2.5 cm and 5.5 cm at the bottom of the top portion, and tapering evenly between those two radii in a shape that accommodates that of the average posterior human toddler's head and neck (see attached diagrams), or the average posterior child's head and neck, and head and neck contours matching the sizes interposed between the average toddler and average child as well as those head sizes between 1 and 20 percent larger than the average toddler head and neck (which has a circumference of 49.5 cm (20 inches) and between 1 and 20 percent smaller than the average toddler head and neck.

Figure 43A:
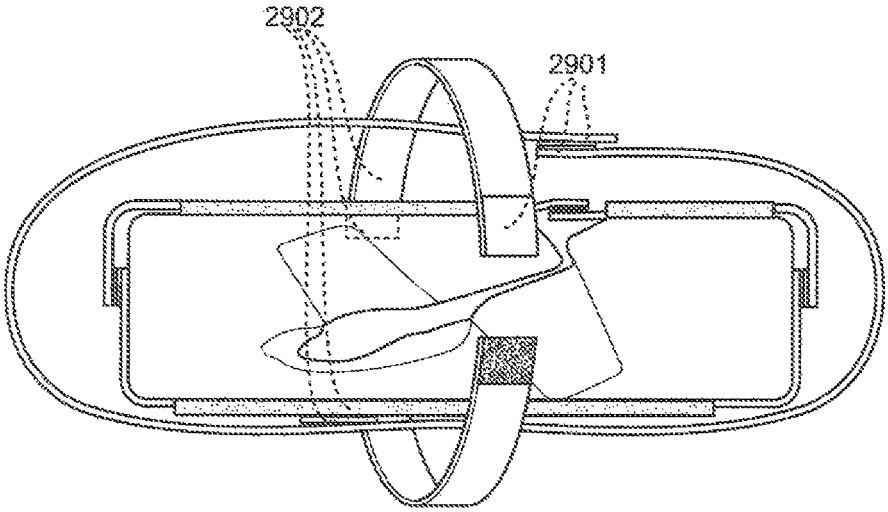
FIG. 43 (A) depicts a pillow with an attachable elastic band, or pair of elastic bands, to use for compression to a smaller size.
Figure 43B:
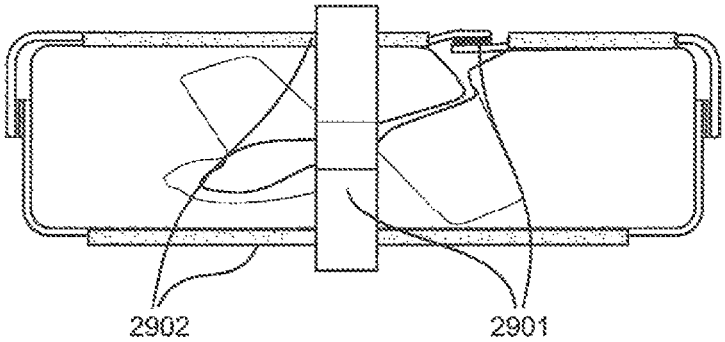
Figure 43C:
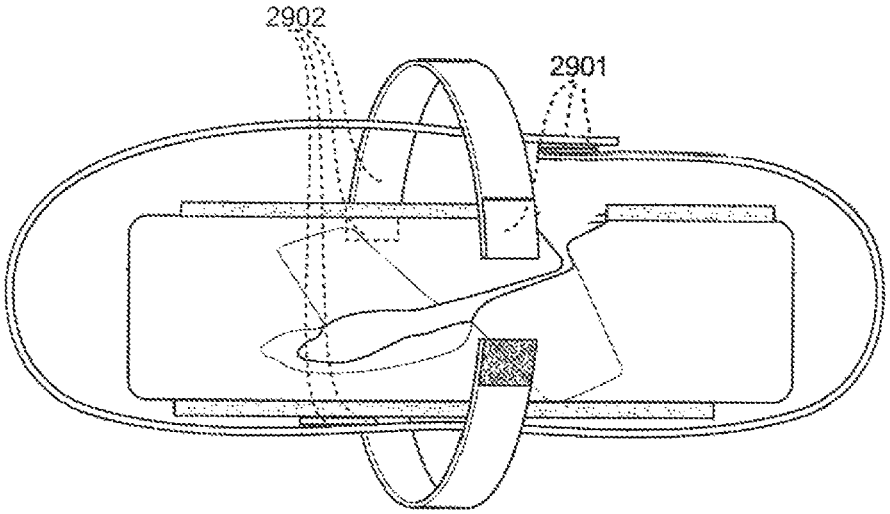
Figure 43D:
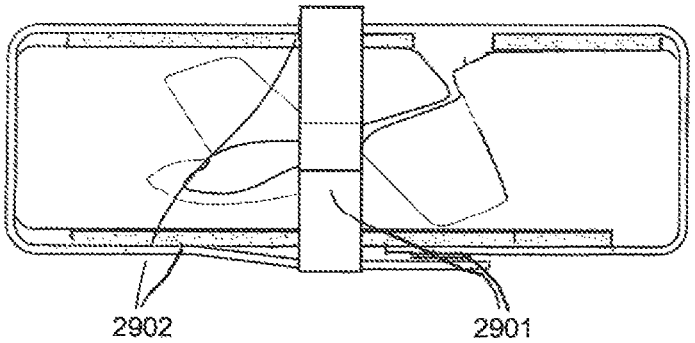

In some embodiments (see FIG. 43) the pillow has an attachable elastic band, or pair of bands, such as elastic bands, to use for compression to a smaller size. The bands wrap around to connect to themselves with either buttons, Velcro® hook and loop assemblies, hooks, buckles and/or magnets (2901). In some embodiments the bands are fastened to the pillow itself with either buttons, Velcro® hook and loop assemblies, hooks, buckles and/or magnets (2902). (FIG. 43(A)), folded with straps open and (FIG. 43(B)) folded and compressed with straps closed). Two of the benefits or utilities of the compressed small size is easier portability and use of a bag, soft or hard case, to permit pillow security and protection, simpler portability, and enhanced aesthetic advantage.

Figure 44:
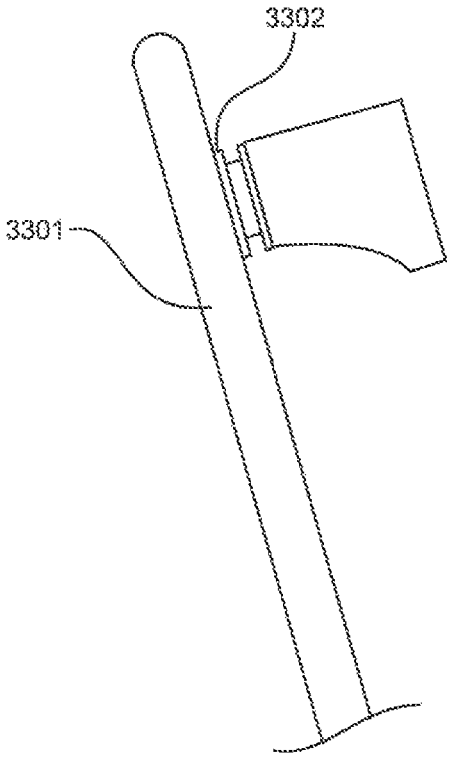
FIG. 44 shows the pillow with an attachment apparatus to fasten it to an airplane seat back. In some embodiments the pillow is (as depicted) part of an integrated airplane seat back design.

In some embodiments (see FIG. 44) the pillow has an attachment apparatus (3302) to fasten it to an airplane seat back (3301). This apparatus may be made of metal, buttons, Velcro® hook and loop assemblies, hooks, buckles and/or magnets and may be adjustable by height to match various passenger head and neck positions. In some embodiments the pillow is part of an integrated airplane seat back design, such as, among other things, a design that airlines and airplane producers choose to incorporate for passenger comfort. In some embodiments the head rests fold laterally so as to allow seat back use without the head rest supports.

In some embodiments (see FIG. 43) the pillow has an attachable elastic band, or pair of elastic bands, to use for compression to a smaller size. The bands wrap around to connect to themselves (2901) with either buttons, Velcro® hook and loop assemblies, hooks, buckles and/or magnets. In some embodiments the bands are fastened to the pillow itself (2902) with either buttons, Velcro® hook and loop assemblies, hooks, buckles and/or magnets. (FIG. 43(A)), folded with straps open and (FIG. 43(B)) folded and compressed with straps closed). Two of the benefits or utilities of the compressed small size is easier portability and use of a bag, soft or hard case, to permit pillow security and protection, simpler portability, and enhanced aesthetic advantage.

In some embodiments (see FIG. 44) the pillow has an attachment apparatus (3302) to fasten it to an airplane seat back (3301). This apparatus may be made of metal, buttons, Velcro® hook and loop assemblies, hooks, buckles and/or magnets and may be adjustable by height to match various passenger head and neck positions. In some embodiments the pillow is part of an integrated airplane seat back design, such as, among other things, a design that airlines and airplane producers choose to incorporate for passenger comfort. In some embodiments the head rests fold laterally so as to allow seat back use without the head rest supports.

Figure 45:
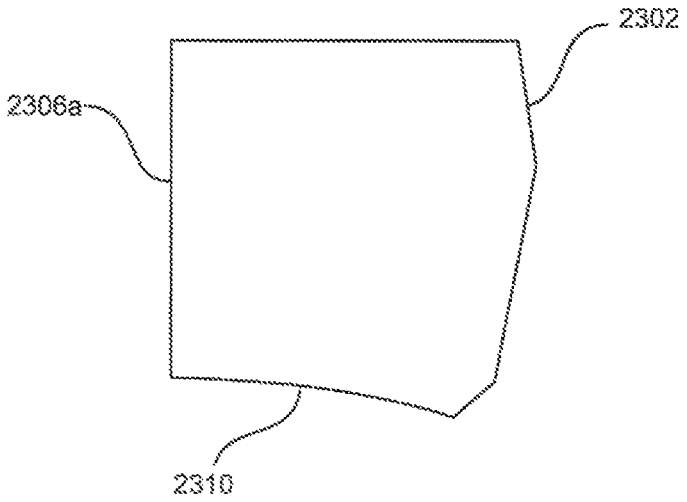
FIG. 45 depicts a side view of the support pillow with an alternative configuration.

In some embodiments the anterior-inferior portion of the side rests that conform to the clavicle (collarbone) are truncated (See FIG. 45). That is in some embodiments the pillow comprises side rests that conform to the clavicle and in some embodiments the side rests do not conform to the clavicle. In this latter embodiment the length of the inferior of the side rest is truncated relative to the length of the side rest that confirms to the clavicle. The side rest lacking clavicle-conforming regions is reduced in length by 0.1 inch, 0.2 inch, 0.3 inch, 0.4 inch, 0.5 inch, 0.6 inch, 0.7 inch, 0.8 inch, 0.9 inch or 1 inch. In some embodiments the reduction in length is from 0.1 to 1 inch, from 0.2 to 0.7 inch or from 0.5 to 0.5 inch. The changes in measurements are approximate within 2 cm. In this version the "slot" (610) on the head rest arm contralateral to the folding arm is eliminated or modified to receive the folding arm with the truncated anterior-inferior configuration, and the firm panel on the side(s) of the side rest(s) are modified to fit the truncated side rest. This configuration applies to both the "tall" and "short" versions of the pillow above described, and may also have beveled or curved edges as above described.

Figure 46:
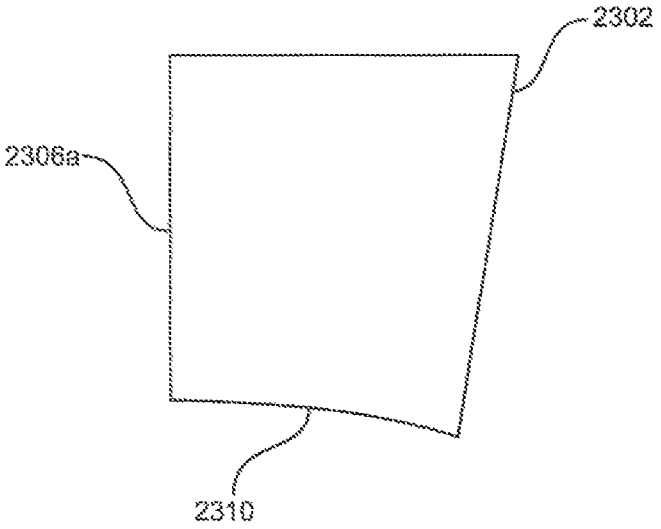
FIG. 46 depicts a side view of the support pillow with an alternative configuration.

In some embodiments of this truncated version described in the above paragraph the entirety of the anterior side rests is truncated (See FIG. 46). In this embodiment the length of the side rest is reduced relative to the length of the clavicle conforming version by 0.5 to 2 inches, or from 0.8 to 1.5 inches or 1 to 1.3 inches. The length may be from 4 to 6 inches or from 4.1 to 5 inches. The changes in measurements are approximate within 2 cm. In this version the "slot" on the head rest arm contralateral to the folding arm is either eliminated or modified to receive the folding arm with the truncated anterior-inferior configuration, and the firm panel on the side(s) of the side rest(s) are modified to fit the truncated side rest. This configuration applies to both the "tall" and "short" versions of the pillow above described, and may also have beveled or curved edges as above described.

Figure 47:
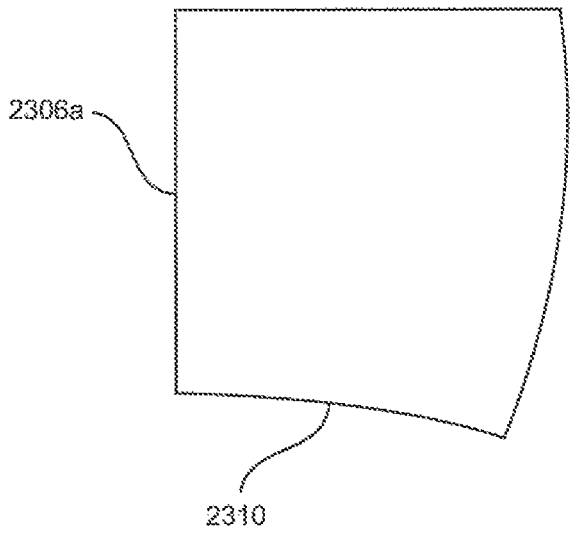
FIG. 47 depicts a side view of the support pillow with an alternative configuration.

In some embodiments of this truncated version described in the above paragraph the entirety of the anterior side rests is truncated and curved with a convex surface anteriorly (See FIG. 47). In this embodiment the width of the superior of the side rest is around 5.09 inches and the width of from the posterior of the pillow to the anterior most edge of the pillow is around 5.27 inches. The changes in measurements are approximate within 2 cm. In this version the "slot" on the head rest arm contralateral to the folding arm is either eliminated or modified to receive the folding arm with the truncated anterior-inferior configuration, and the firm panel on the side(s) of the side rest(s) are modified to fit the truncated side rest. This configuration applies to both the "tall" and "short" versions of the pillow above described, and may also have beveled or curved edges as above described.

Once made, the pillow, which has been referred to herein as a support pillow, finds a variety of uses. In one embodiment the pillow finds use as a support pillow for air travel, ground vehicle, or other mode of travel for comfort or needed head or neck immobilization. In alternative embodiments the pillow finds use in sleeping whether traveling or not. In a similar or an entirely separate embodiment the pillow can be used while resting in a chair, sofa, or other mode of seating. In a particular embodiment the pillow finds use with patients following injuries, medical procedures, or surgery. Frequently following such surgeries or occurrences, patients are required to sleep on their back since the pillow encourages the ability to do that comfortably. This would apply to cosmetic surgeries and non-cosmetic head or neck surgeries in particular. Accordingly the disclosure herein provides a method of immobilizing a post-surgical patient by having the patient recline into the pillow as described herein, ensuring that the head is comfortably immobilized. This would also apply to resting and sleeping in a reclined or supine position on a patient's back after an injury or medical procedure; such positioning of the head and neck promotes healing and ensures stability and comfort.

While the various embodiments of the present invention have been described above, it should be understood that they have been presented by way of example only, and not of limitation. Likewise, the figure may depict an example architectural or other configuration for the invention, which is done to aid in understanding the features and functionality that can be included in the invention. The invention is not restricted to the illustrated example architectures or configurations, but the desired features can be implemented using a variety of alternative architecture and configurations.

I claim:

1. A pillow for supporting a neck and a head of a user in a supine, inclined or upright position, the pillow assembly comprising: a. headrest portion; b. a first and second side rest for supporting the head of the user, wherein a headrest portion is positioned between the first and second side rests and wherein the headrest portion comprises a curved interior for supporting the posterior part of the head and neck, having a larger radius at its upper portion that tapers to a smaller radius at its lower portion; c. an arch-shaped bottom portion, wherein a bottom portion of said arch-shaped bottom portion rests on a nape of the neck of the user, further wherein a top of the arch shaped bottom portion is positioned at a base of the head rest and the bottom portion of the arch shaped bottom portion is positioned at a base of the first and second side rests; d. first and second ear recesses on first and second lateral sides of the headrest portion, wherein said ear recesses are configured to receive ears of the user; e. first and second trapezius recesses on the bottom portion of the arch shaped bottom portion positioned at the base of the first and second side rests, said trapezius recesses configured to receive a trapezius muscle of the user; f. a curve on a first and second inferior surface of each side rest that rests on shoulders of the user, slanting downward from posterior to anterior as it extends from the posterior shoulder area down to overlie a clavicle area of the user; g. an inward angle between the antero-posterior axis of each side rest and a perpendicular line from the rear of the pillow of between five (5) and 20 (twenty) degrees; h. a rigid support on a back surface of the pillow, a front surface of the first side rest and a lateral surface of the second side rest; and i. a notch on an interior of said first side rest, configured to receive a front, interior edge of said second side rest when said side rest is folded inward for portability, wherein said pillow has a length of 25-50 cm and wherein said pillow is configured to be capable of folding into a collapsed configuration.

2. The pillow according to claim 1, further comprising at least one strap configured to compress the pillow when collapsed.

3. The pillow according to claim 2, comprising at least two straps configured to compress the pillow when collapsed.

4. The pillow according to claim 1, wherein the rigid support on the back of the pillow covers 70% of the back of the pillow.

5. The pillow according to claim 1, wherein the rigid support on the back surface of the pillow is aligned flush with the lateral surface of the first side rest.

6. The pillow according to claim 1, wherein the ear recesses have a quarter-ellipsoid shape to receive the lower portion of the user's ear, and wherein said quarter-ellipsoid has a maximum supero-inferior dimension of 6 cm, a maximum antero-posterior dimension of 6 cm, and a maximum left-right dimension (depth) of 2.2 cm.

7. The pillow according to claim 1, wherein the height of the pillow, measured 2 cm posterior to the anterior-most extent of the side rests, is 15 cm; and wherein the posterior height of the pillow, measured at the posterior-most extent of the side rests, is 13 cm.

8. The pillow according to claim 7, wherein the antero-posterior depth of the pillow, measured 2.5 cm from the bottom of the pillow and 3.5 cm from the lateral-most extent of the side rests, is 18 cm; and wherein the antero-posterior depth of the top of the pillow, measured 3.5 cm from the lateral-most extent of the side rests, is 15.5 cm.

9. The pillow according to claim 1, wherein each side rest is angled forward perpendicularly (90 degrees) to the rear of the pillow.

10. The pillow according to claim 1, wherein the height of the pillow, measured 2 cm posterior to the anterior-most extent of the side rests, is 22 cm; and wherein the posterior height of the pillow, measured at the posterior-most extent of the side rests, is 17 cm.

11. The pillow according to claim 1, comprising a single piece of polyester, polyurethane, polyether urethane, latex, visco-elastic or memory foam.

12. The pillow according to claim 11, made from high pressure compression molded polyether urethane at a 0.25-5 lb/cu·ft. density.

13. The pillow according to claim 12, comprising a coating of smooth polyurethane or plastic from 0.1 to 2.5 mm thick.

14. The pillow according to claim 13, wherein said smooth polyurethane or plastic is capable of allowing for surface cleaning or sterilization.

15. The pillow according to claim 1, further comprising at least one attachment feature selected from the group consisting of carabiner, hook, and loop.

16. The pillow according to claim 1, wherein the length of the pillow is 25 cm, 26 cm, 27 cm, 28 cm, 29 cm, 30 cm or within 10% higher or lower than 25 cm, 26 cm, 27 cm, 28 cm, 29 cm, or 30 cm.

* * * * *